US009714648B2

(12) United States Patent
Kim et al.

(10) Patent No.: US 9,714,648 B2
(45) Date of Patent: Jul. 25, 2017

(54) LINEAR COMPRESSOR

(71) Applicant: LG ELECTRONICS INC., Seoul (KR)

(72) Inventors: Jookon Kim, Seoul (KR); Chulgi Roh, Seoul (KR); Sungtaek Woo, Seoul (KR); Sangsub Jeong, Seoul (KR); Kyoungseok Kang, Seoul (KR); Wonhyun Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 332 days.

(21) Appl. No.: 14/317,336

(22) Filed: Jun. 27, 2014

(65) Prior Publication Data

US 2015/0004014 A1 Jan. 1, 2015

(30) Foreign Application Priority Data

Jun. 28, 2013 (KR) ..... 10-2013-0075512
Jun. 28, 2013 (KR) ..... 10-2013-0075514
Oct. 4, 2013 (KR) ..... 10-2013-0118537
Oct. 4, 2013 (KR) ..... 10-2013-0118538
Oct. 4, 2013 (KR) ..... 10-2013-0118539

(51) Int. Cl.
*F04B 35/04* (2006.01)
*F04B 39/00* (2006.01)

(52) U.S. Cl.
CPC ..... *F04B 39/0027* (2013.01); *F04B 35/045* (2013.01); *F04B 39/0016* (2013.01); *F04B 39/0061* (2013.01); *F04B 39/0055* (2013.01)

(58) Field of Classification Search
CPC F04B 35/045; F04B 39/0055; F04B 39/0061; F04B 39/0072
USPC ..... 417/312, 417
See application file for complete search history.

(56) References Cited

U.S. PATENT DOCUMENTS 3,007,625 A 11/1961 Heinrich
3,143,281 A 8/1964 Heinrich
3,813,192 A 5/1974 Adams
4,027,211 A 5/1977 Omura
4,827,163 A 5/1989 Bhate et al.
(Continued)

FOREIGN PATENT DOCUMENTS

CN 1480648 3/2004
CN 1508427 6/2004
(Continued)

OTHER PUBLICATIONS

European Search Report dated Sep. 7, 2015.
(Continued)

*Primary Examiner* — Peter J Bertheaud
(74) *Attorney, Agent, or Firm* — KED & Associates, LLP

(57) ABSTRACT

A linear compressor is provided. The linear compressor may include a shell including a refrigerant inlet, a cylinder provided within the shell, a piston that reciprocates within the cylinder, and a suction muffler provided movable together with the piston. The suction muffler may include a muffler main body that defines a refrigerant passage, a main body insertion portion press-fitted into the muffler main body, and a piston insertion portion press-fitted into the muffler main body to extend into the piston. The piston insertion portion may correspond to the main body insertion portion in configuration.

26 Claims, 15 Drawing Sheets

(56) References Cited

U.S. PATENT DOCUMENTS

| | | | | |
|---|---|---|---|---|
| 4,924,675 | A | 5/1990 | Higham | |
| 4,932,313 | A | 6/1990 | Gutknecht | |
| 4,937,481 | A | 6/1990 | Vitale | |
| 5,559,378 | A | 9/1996 | Oudet et al. | |
| 5,693,991 | A | 12/1997 | Hiterer et al. | |
| 5,704,771 | A | 1/1998 | Fujisawa | |
| 6,097,125 | A | 8/2000 | Park et al. | |
| 6,273,688 | B1 | 8/2001 | Kawahara | |
| 6,328,544 | B1 | 12/2001 | Kawahara et al. | |
| 6,379,125 | B1 | 4/2002 | Tojo | |
| 6,398,523 | B1 | 6/2002 | Hur et al. | |
| 6,413,057 | B1 | 7/2002 | Hong | |
| 6,435,842 | B2 | 8/2002 | Song | |
| 6,561,144 | B1 | 5/2003 | Muraji | |
| 6,575,716 | B1 | 6/2003 | Morita et al. | |
| 6,666,662 | B2 | 12/2003 | Oh | |
| 6,755,627 | B2 | 6/2004 | Chang | |
| 6,793,470 | B2 | 9/2004 | Song | |
| 6,863,506 | B2 | 3/2005 | Park | |
| 6,875,000 | B2 | 4/2005 | Bae | |
| 6,894,407 | B2 | 5/2005 | Jung | |
| 6,994,530 | B2 | 2/2006 | Fujisawa et al. | |
| 7,288,862 | B2 | 10/2007 | Song | |
| 7,331,772 | B2 | 2/2008 | Jung | |
| 7,404,701 | B2 | 7/2008 | Kwon | |
| 7,478,996 | B2 * | 1/2009 | Kang | F04B 35/045 181/229 |
| 7,537,438 | B2 | 5/2009 | Song | |
| 7,614,856 | B2 | 11/2009 | Inagaki et al. | |
| 7,617,594 | B2 | 11/2009 | Hyeon | |
| 7,626,289 | B2 | 12/2009 | Her | |
| 7,649,285 | B2 | 1/2010 | Ueda | |
| 7,748,963 | B2 * | 7/2010 | Lee | F04B 35/045 417/415 |
| 7,748,967 | B2 | 7/2010 | Park | |
| 7,775,775 | B2 | 8/2010 | Cho | |
| 7,901,192 | B2 | 3/2011 | Cho | |
| 7,922,463 | B2 | 4/2011 | Lee | |
| 7,934,910 | B2 | 5/2011 | Park | |
| 8,109,199 | B2 | 2/2012 | Kim | |
| 8,109,740 | B2 | 2/2012 | Kang | |
| 8,303,273 | B2 | 11/2012 | Kang | |
| 8,556,599 | B2 | 10/2013 | Lee | |
| 2003/0147759 | A1 | 8/2003 | Chang | |
| 2004/0047750 | A1 | 3/2004 | Kim et al. | |
| 2004/0061583 | A1 | 4/2004 | Yumita | |
| 2004/0109777 | A1 | 6/2004 | Hur | |
| 2004/0145248 | A1 | 7/2004 | Jung et al. | |
| 2004/0247457 | A1 * | 12/2004 | Kim | F04B 35/045 417/312 |
| 2005/0098031 | A1 | 5/2005 | Yoon et al. | |
| 2005/0140216 | A1 | 6/2005 | Lee | |
| 2005/0142007 | A1 | 6/2005 | Lee | |
| 2005/0214140 | A1 | 9/2005 | Lee | |
| 2006/0024181 | A1 | 2/2006 | Kim | |
| 2006/0060196 | A1 | 3/2006 | Kim | |
| 2006/0145797 | A1 | 7/2006 | Muramatsu et al. | |
| 2006/0171825 | A1 | 8/2006 | Choi | |
| 2006/0280630 | A1 | 12/2006 | Lee et al. | |
| 2007/0009370 | A1 | 1/2007 | Kim et al. | 417/417 |
| 2007/0110600 | A1 | 5/2007 | Park | |
| 2007/0134108 | A1 | 6/2007 | Her | |
| 2007/0166176 | A1 | 7/2007 | Kang et al. | |
| 2008/0000348 | A1 | 1/2008 | Schubert et al. | |
| 2009/0101003 | A1 | 4/2009 | Kim et al. | |
| 2010/0021323 | A1 | 1/2010 | Schubert | |
| 2010/0260627 | A1 | 10/2010 | Kang et al. | |
| 2010/0260628 | A1 | 10/2010 | Kim | |
| 2010/0260629 | A1 * | 10/2010 | Kang | F04B 39/0061 417/417 |
| 2010/0266429 | A1 | 10/2010 | Kang et al. | |
| 2010/0290936 | A1 | 11/2010 | Kang et al. | |
| 2010/0316513 | A1 * | 12/2010 | Lee | F04B 39/14 417/417 |
| 2011/0194957 | A1 | 8/2011 | Kang et al. | |
| 2013/0004343 | A1 | 1/2013 | Cho et al. | |
| 2013/0058815 | A1 | 3/2013 | Kim | |
| 2013/0195613 | A1 | 8/2013 | Kim | |

FOREIGN PATENT DOCUMENTS

| | | | |
|---|---|---|---|
| CN | 1862016 | | 11/2006 |
| CN | 101133247 | | 2/2008 |
| CN | 101835983 | | 9/2010 |
| CN | 203770066 | | 8/2014 |
| CN | 203835658 | | 9/2014 |
| CN | 203867810 | | 10/2014 |
| CN | 203906211 | | 10/2014 |
| CN | 203906214 | | 10/2014 |
| CN | 203978749 | | 12/2014 |
| EP | 2 312 157 | | 4/2011 |
| JP | 05-240156 | A | 9/1993 |
| JP | 2000-002181 | | 1/2000 |
| JP | 2001-158995 | A | 6/2001 |
| JP | 2002-122072 | | 4/2002 |
| JP | 2002-138954 | A | 5/2002 |
| JP | 2006-280156 | A | 10/2006 |
| JP | 2007-291991 | | 11/2007 |
| JP | 2010-200522 | A | 9/2010 |
| JP | 2013-015092 | A | 1/2013 |
| KR | 10-0792460 | | 1/2008 |
| KR | 10-2010-0010421 | | 2/2010 |
| KR | 10-2010-0112474 | | 10/2010 |
| KR | 10-2013-0118464 | A | 10/2013 |
| KR | 10-2013-0118580 | A | 10/2013 |
| KR | 10-2013-0075512 | A | 10/2014 |
| KR | 10-2013-0075514 | A | 10/2014 |
| WO | WO 02077455 | A1 | 10/2002 |
| WO | WO 2007/046608 | | 4/2007 |
| WO | WO 2012/088571 | | 7/2012 |

OTHER PUBLICATIONS

European Search Report dated Sep. 25, 2015.
Korean Office Action dated Oct. 13, 2014 issued in Application No. 10-2013-0075512.
Korean Office Action dated Oct. 13, 2014 issued in Application No. 10-2013-0075514.
Chinese Patent Certificate dated Aug. 13, 2014 issued in Application No. 201420160887.6 (patented as CN 203770066 U).
Chinese Patent Certificate dated Sep. 17, 2014 issued in Application No. 201420187800.4 (patented as CN 203835658 U).
European Search Report dated Nov. 14, 2014 issued in Application No. 14 16 8916.6.
European Search Report dated Sep. 17, 2015.
European Search Report dated Oct. 2, 2015.
European Search Report dated Oct. 14, 2015.
Chinese Office Action date Dec. 28, 2015.
Chinese Office Action dated Dec. 14, 2015.
Chinese Office Action dated Dec. 25, 2015.
Chinese Office Action dated Dec. 28, 2015.
(3)Chinese Office Actions dated Dec. 30, 2015.
U.S. Office Action issued in U.S. Appl. No. 14/317,172 dated May 19, 2016.
U.S. Office Action issued in U.S. Appl. No. 14/317,217 dated Jun. 15, 2016.
U.S. Office Action issued in U.S. Appl. No. 14/317,218 dated May 20, 2016.
U.S. Office Action issued in U.S. Appl. No. 14/317,120 dated Jun. 2, 2016.
European Search Report issued in Application No. 14169566.8 dated Aug. 10, 2015.
Korean Office Action dated Jul. 24, 2014.
European Search Report dated Sep. 21, 2015.
Chinese Patent No. 104251196 issued Oct. 5, 2016.
European Search Report dated Oct. 12, 2016 issued in Application No. 16172236.8.
United States Office Action dated Jan. 26, 2017 issued in U.S. Appl. No. 14/317,041.

(56) References Cited

OTHER PUBLICATIONS

U.S. Office Action dated Dec. 1, 2016 issued in U.S. Appl. No. 14/317,172.
U.S. Office Action dated Dec. 5, 2016 issued in U.S. Appl. No. 14/317,120.
U.S. Office Action dated Dec. 16, 2016 issued in U.S. Appl. No. 14/317,217.
United States Office Action dated Sep. 30, 2016 issued in U.S. Appl. No. 14/316,908.
United States Office Action dated Oct. 11, 2016 issued in U.S. Appl. No. 14/280,825.
United States Final Office Action dated Oct. 17, 2016 issued in U.S. Appl. No. 14/317,218.
U.S. Appl. No. 14/280,825, filed May 19, 2014.
U.S. Appl. No. 14/316,908, filed Jun. 27, 2014.
U.S. Appl. No. 14/317,172, filed Jun. 27, 2014.
U.S. Appl. No. 15/491,077, filed Apr. 19, 2017.
U.S. Appl. No. 14/317,217, filed Jun. 27, 2014.
U.S. Appl. No. 14/317,218, filed Jun. 27, 2014.
U.S. Appl. No. 14/317,120, filed Jun. 27, 2014.
Chinese Office Action dated Mar. 3, 2017 (English Translation).

* cited by examiner

LINEAR COMPRESSOR

CROSS-REFERENCE TO RELATED APPLICATION(S)

The present application claims priority under 35 U.S.C. 119 and 35 U.S.C. 365 to Korean Patent Application No. 10-2013-0075512, filed in Korea on Jun. 28, 2013, No. 10-2013-0075514, filed in Korea on Jun. 28, 2013, No. 10-2013-0118537, filed in Korea on Oct. 4, 2013, No. 10-2013-0118538, filed in Korea on Oct. 4, 2013, and No. 10-2013-0118539, filed in Korea on Oct. 4, 2013, which are hereby incorporated by reference in their entirety.

BACKGROUND

1. Field

A linear compressor is disclosed herein.

2. Background.

In general, compressors may be mechanisms that receive power from power generation devices, such as electric motors or turbines to compress air, refrigerants, or other working gases, thereby increasing a pressure of the working gas. Compressors are being widely used in home appliances or industrial machineries, such as refrigerators and air-conditioners.

Compressors may be largely classified into reciprocating compressors, in which a compression space, into and from which a working gas, such as a refrigerant, is suctioned and discharged, is defined between a piston and a cylinder to compress a refrigerant while the piston is linearly reciprocated within the cylinder; rotary compressors, in which a compression space into and from which a working gas, such as a refrigerant, is suctioned and discharged, is defined between a roller, which is eccentrically rotated, and a cylinder to compress a refrigerant while the roller is eccentrically rotated along an inner wall of the cylinder; and scroll compressors, in which a compression space, into and from which a working gas, such as a refrigerant, is suctioned and discharged, is defined between an orbiting scroll and a fixed scroll to compress the refrigerant while the orbiting scroll is rotated along the fixed scroll. In recent years, among the reciprocating compressors, linear compressors having a simple structure in which a piston is directly connected to a drive motor, which is linearly reciprocated, to improve compression efficiency without mechanical loss due to switching in moving are being actively developed. Generally, such a linear compressor is configured to suction and compress a refrigerant while a piston is linearly reciprocated within a cylinder by a linear motor in a sealed shell, thereby discharging the compressed refrigerant.

The linear motor has a structure in which a permanent magnet is disposed between an inner stator and an outer stator. The permanent magnet may be linearly reciprocated by a mutual electromagnetic force between the permanent magnet and the inner (or outer) stator. Also, as the permanent magnet is operated in a state in which the permanent magnet is connected to the piston, the refrigerant may be suctioned and compressed while the piston is linearly reciprocated within the cylinder and then be discharged. Also, the linear compressor may include a muffler in which a refrigerant passage, through which a refrigerant passes is defined to reduce noise.

A muffler device of a linear compressor according to the related art is disclosed in Korean Patent Publication No. 10-2010-0010421. The linear compressor according to the related art includes a muffler that guides a fluid suctioned into a suction pipe of a back cover to a fluid suction passage of a piston and reduces noise. The muffler includes a muffler main body and a sound absorption tube that protrudes to a center of a front end of the piston.

According to the related art, even though noise reduction effects due to the muffler are expected, the noise reduction effects may be insignificant. Also, there are limitations in reducing noise sources, such as various frequencies (high and low frequencies), that are generated in electrical components, to which the linear compressor is applied, for example, refrigerators or air conditioners.

Also, mufflers according to the related art may be formed of a metal material. When the muffler is formed of a metal material, it may be difficult to mold the muffler, and the assembly process may be complicated. Also, an inside of the piston or cylinder may be under a high temperature environment. Thus, if the muffler is formed of a metal material having a high heat transfer rate, a large amount of heat loss may occur through the muffler.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described with reference to the accompanying drawings. Embodiments may, however, be embodied in many different forms and should not be construed as being limited to the embodiments set forth herein; rather, alternate embodiments included in other retrogressive inventions or falling within the spirit and scope of the present disclosure will fully convey the concept of the invention to those skilled in the art.

Figure 1:
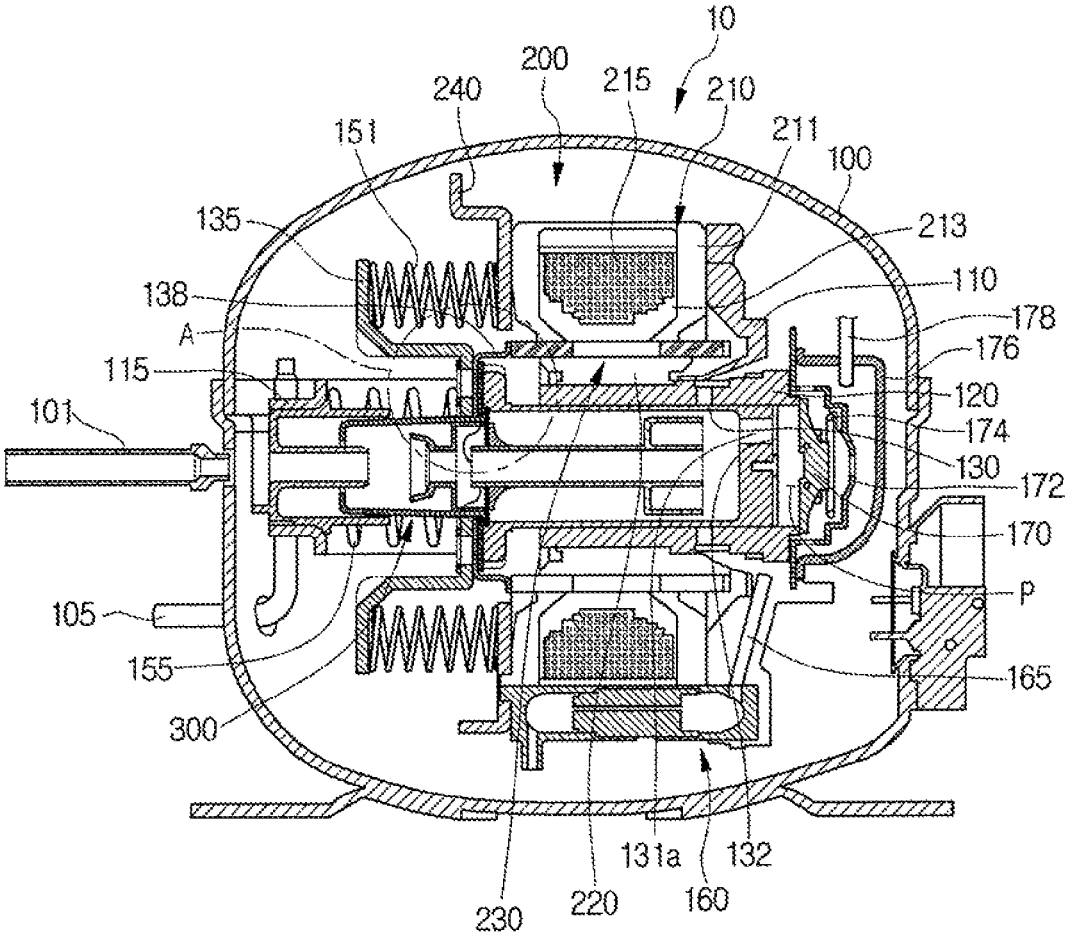
FIG. 1 is a cross-sectional view of a linear compressor according to an embodiment.

FIG. 1 is a cross-sectional view of a linear compressor according to an embodiment. Referring to FIG. 1, the linear compressor 10 may include a cylinder 120 disposed in a shell 100, a piston 130 that linearly reciprocates inside the cylinder 120, and a motor assembly 200, which may be a linear motor, that exerts a drive force on the piston 130. The shell 100 may include an upper shell and a lower shell.

The cylinder 120 may be formed of a non-magnetic material, such as an aluminum-based material, for example, aluminum or aluminum alloy. As the cylinder 120 may be formed of the aluminum-based material, magnetic flux generated in the motor assembly 200 may be transmitted to the cylinder 120, thereby preventing the magnetic flux from leaking to the outside of the cylinder 10. Also, the cylinder 120 may be formed by extruded rod processing, for example.

The piston 130 may be formed of a non-magnetic material, such as an aluminum-based material, for example, aluminum or aluminum alloy. As the piston 130 may be formed of the aluminum-based material, magnetic flux generated in the motor assembly 200 may be delivered to the piston 130, thereby preventing the magnetic flux from leaking to the outside of the piston 130. Also, the piston 130 may be formed by forging, for example.

Also, the cylinder 120 and the piston 130 may have a same material composition ratio, that is, type and composition ratio. The piston 130 and the cylinder 120 may be formed of a same material, for example, aluminum, and thus, may have a same thermal expansion coefficient. During operation of the linear compressor 10, a high-temperature environment (about 100℃) may be created in the shell 100. At this time, the piston 130 and the cylinder 120 may have a same thermal expansion coefficient, and thus, may have a same amount of thermal deformation. As a result, as the piston 130 and the cylinder 120 may be thermally deformed in different amounts or directions, it may be possible to prevent interference with the cylinder 120 during movement of the piston 130.

The shell 100 may include an inlet 101, through which a refrigerant may be introduced into the shell 100, and a discharge 105, through which the refrigerant compressed in the cylinder 120 may be discharged. The refrigerant suctioned in through the inlet 101 may flow into the piston 130 via a suction muffler 300. While the refrigerant passes through the suction muffler 300, noise having various frequencies may be reduced.

A compression space P to compress the refrigerant by the piston 130 may be defined in the cylinder 120. A suction hole 131*a*, through which the refrigerant may be introduced into the compression space P, may be defined in the piston 130, and a suction valve 132 that selectively opens the suction hole 131*a* may be disposed at a side of the suction hole 131*a*.

A discharge valve assembly 170, 172, and 174 to discharge the refrigerant compressed in the compression space P may be disposed at a side of the compression space P. That is, the compression space P may be formed between an end of the piston 130 and the discharge valve assembly 170, 172, and 174.

The discharge valve assembly 170, 172, and 174 may include a discharge cover 172, in which a discharge space for the refrigerant may be defined, a discharge valve 170, which may be opened and introduce the refrigerant into the discharge space when the pressure of the compression space P is not less than a discharge pressure, and a valve spring 174 disposed between the discharge valve 170 and the discharge cover 172 to exert an elastic force in an axial direction. Herein, the term "axial direction" may refer to a direction in which the piston linearly reciprocates, that is, a horizontal direction in FIG. 1.

The suction valve 132 may be disposed at a first side of the compression space P, and the discharge valve 170 may be disposed a second other side of the compression space P, that is, at an opposite side of the suction valve 132. While the piston 130 is linearly reciprocated inside the cylinder 120, the suction valve 132 may be opened to allow the refrigerant to be introduced into the compression space P if the pressure of the compression space P is lower than the discharge pressure and not greater than a suction pressure. In contrast, if the pressure of the compression space P is not less than the suction pressure, the refrigerant of the compression space P may be compressed in a state in which the suction valve 132 is closed.

If the pressure of the compression space P is the discharge pressure or greater, the valve spring 174 may be deformed to open the discharge valve 170 and the refrigerant discharged from the compression space P into the discharge space of the discharge cover 172. The refrigerant of the discharge space may flow into a loop pipe 178 via a discharge muffler 176. The discharge muffler 176 may reduce flow noise of the compressed refrigerant, and the loop pipe 178 may guide the compressed refrigerant to the discharge 105. The loop pipe 178 may be coupled to the discharge muffler 176 and curvedly extend to be coupled to the discharge 105.

The linear compressor 10 may further include a frame 110. The frame 110, which may fix the cylinder 200 with the shell 100, may be integrally formed with the cylinder 200 or may be installed by means of a separate fastening member, for example. The discharge cover 172 and the discharge muffler 176 may be coupled to the frame 110.

The motor assembly 200 may include an outer stator 210, which may be fixed to the frame 110 and disposed so as to surround the cylinder 120, an inner stator 220 disposed apart from an inside of the outer stator 210, and a permanent magnet 230 disposed in a space between the outer stator 210 and the inner stator 220. The permanent magnet 230 may linearly reciprocate by mutual electromagnetic force between the outer stator 210 and the inner stator 220. Also, the permanent magnet 230 may be include a single magnet having one pole, or multiple magnets having three poles. Also, the permanent magnet 230 may be formed of a ferrite material, which may be relatively inexpensive.

The permanent magnet 230 may be coupled to the piston 130 by a connection member 138. The connection member 138 may extend to the permanent magnet 230 from an end of the piston 130. As the permanent magnet 230 linearly moves, the piston 130 may linearly reciprocate in an axial direction along with the permanent magnet 230.

The outer stator 210 may include a bobbin 213, a coil 215, and a stator core 211. The coil 215 may be wound in a circumferential direction of the bobbin 213. The coil 215 may have a polygonal section, for example, a hexagonal section. The stator core 211 may be provided such that a plurality of laminations are stacked in a circumferential direction, and may be disposed to surround the bobbin 213 and the coil 215.

When current is applied to the motor assembly 200, the current may flow into the coil 215, and the magnetic flux may flow around the coil 215 due to the current flowing into the coil 215. The magnetic flux may form a close circuit along the outer stator 210 and the inner stator 220. The magnetic flux flowing along the outer stator 210 and the inner stator 220 and the magnetic flux of the permanent magnet 230 may mutually act on each other to generate a force to move the permanent magnet 230.

A stator cover 240 may be disposed at a side of the outer stator 210. A first end of the outer stator 210 may be supported by the frame 110, and a second end thereof may be supported by the stator cover 240.

The inner stator 220 may be fixed to an outer circumference of the cylinder 120. The inner stator 220 may be configured such that a plurality of laminations are stacked at an outer side of the cylinder 120 in a circumferential direction.

The linear compressor 10 may further include a supporter 135 that supports the piston 130, and a back cover 115 coupled to a front portion of the supporter 135. The supporter 135 may be coupled to an outside of the connection member 138. Also, the back cover 115 may be disposed to cover at least a portion of the suction muffler 300.

The linear compressor 10 may also include a plurality of springs 151 and 155, a natural frequency of each of which may be adjusted so as to allow the piston 130 to perform resonant motion. The plurality of springs 151 and 155 may be elastic members.

The plurality of springs 151 and 155 may include a plurality of first springs 151 supported between the supporter 135 and the stator cover 240, and a plurality of second springs 155 supported between the supporter 135 and the back cover 115. The plurality of first and the second springs 151 and 155 may each have a same elastic coefficient.

The plurality of first springs 151 may be provided at upper and lower sides of the cylinder 120 or piston 130, and the plurality of second springs 155 may be provided at a front of the cylinder 120 or piston 130. Herein, the term "front" may refer to a direction oriented toward the inlet 101 from the piston 130. The term 'rear' may refer to a direction oriented toward the discharge valve assembly 170, 172, and 174 from the inlet 101. That is, a front side (or upstream) and a rear side (or downstream) may be defined with respect to a flow direction of the refrigerant. Also, the term a radius direction may refer to a direction perpendicular to front and rear directions. These terms may also be equally used in the following description.

A predetermined amount of oil may be stored in or on an inner bottom surface of the shell 100. An oil supply device 160 to pump oil may be provided in a lower portion of the shell 100. The oil supply device 160 may be operated by vibration generated according to a linear reciprocating motion of the piston 130 to thereby pump the oil upward.

The linear compressor 10 may further include an oil supply pipe 165 that guides the flow of the oil from the oil supply device 160. The oil supply pipe 165 may extend from the oil supply device 160 to a space between the cylinder 120 and the piston 130. The oil pumped from the oil supply device 160 may be supplied to the space between the cylinder 120 and the piston 130 via the oil supply pipe 165, and perform cooling and lubricating operations.

Figure 2:
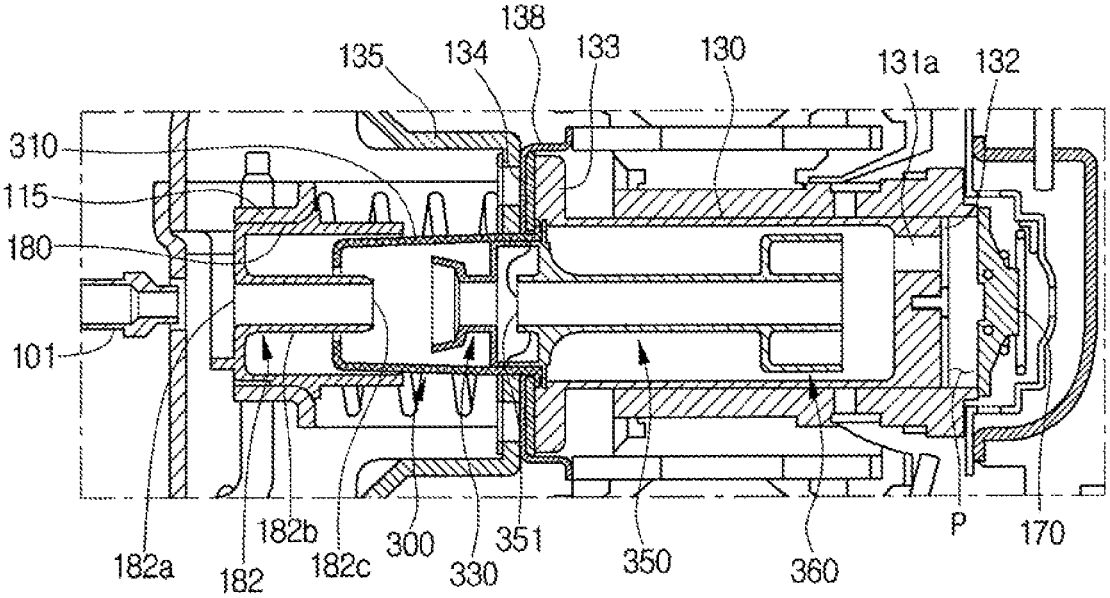
FIG. 2 is a cross-sectional view of a suction muffler of the linear compressor of FIG. 1.
Figure 3:
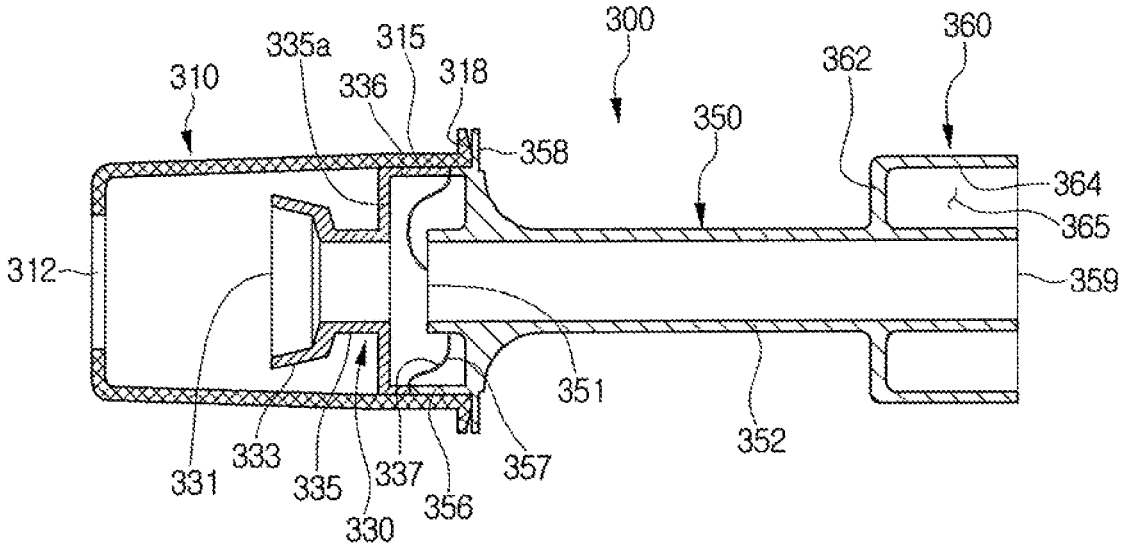
FIG. 3 is a cross-sectional view of the suction muffler of FIG. 2.
Figure 4:
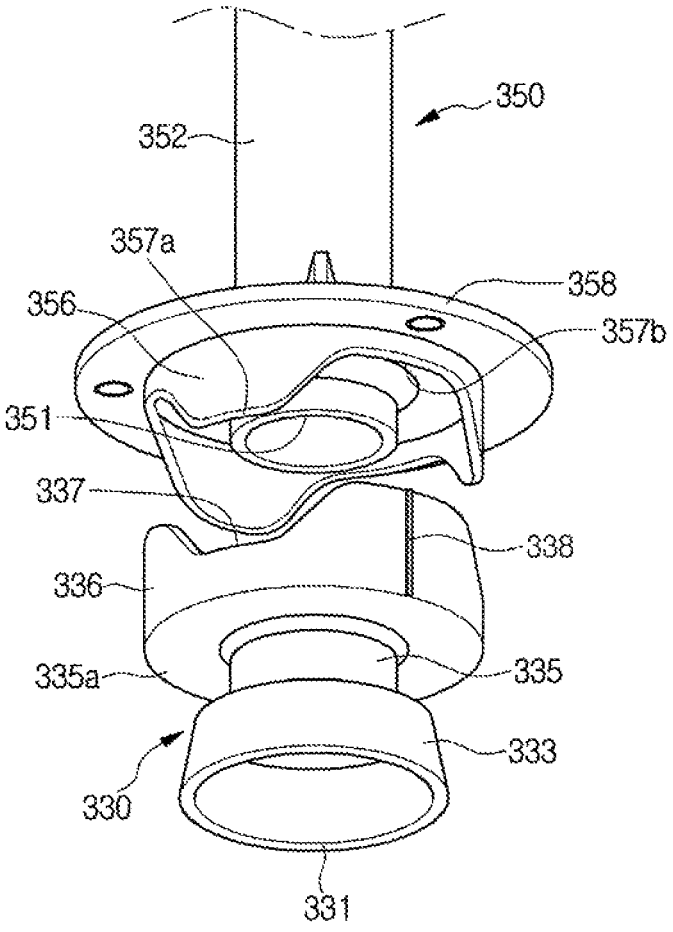
FIG. 4 is an exploded perspective view of a piston insertion portion and a main body insertion portion of the suction muffler according to an embodiment.
Figure 5:
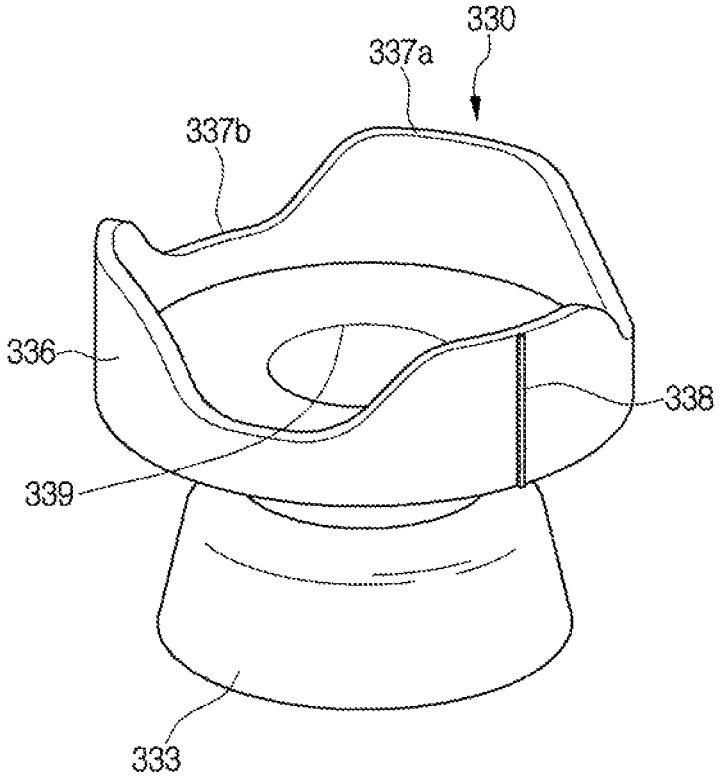
FIG. 5 is a perspective view of the main body insertion portion according to an embodiment.

FIG. 2 is a cross-sectional view of a suction muffler of the linear compressor of FIG. 1. FIG. 3 is a cross-sectional view of the suction muffler of FIG. 2. FIG. 4 is an exploded perspective view of a piston insertion portion and a main body insertion portion of the suction muffler according to an embodiment. FIG. 5 is a perspective view of the main body insertion portion according to an embodiment.

Referring to FIGS. 2 to 5, the linear compressor 10 according to an embodiment may include an inflow pipe 182 disposed inside the shell 100, to which the inlet 101 may be coupled, and a muffler guide 180 that surrounds the inflow pipe 182 and is supported inside the back cover 115. The inflow pipe 182 may include a pipe inflow hole **182*a* defined adjacent to the inlet 101 to guide an inflow of the refrigerant, a pipe body 182*b* that extend backward from the pipe inflow hole 182*a*, and a pipe discharge hole 182*c* to discharge the refrigerant passing through the pipe body 182*b***.

The muffler guide 180 may have an approximately cylindrical shape. A space, into which a suction muffler 300 may move, may be defined in the muffler guide 180. The muffler guide 180 may extend forward and backward to guide movement of a main body of the suction muffler 300, that is, muffler main body 310. The muffler main body 310 may move into the muffler guide 180.

The linear compressor 10 may include the suction muffler 300, that a muffler device having a refrigerant passage through which the refrigerant may flow. The suction muffler 300 may be movable forward and backward together with the piston 130.

The suction muffler 300 may be formed of a plastic material having a limited heat transfer property. For example, the suction muffler 300 may be formed of a polybutylen terephthalate (PBT) resin and a glass fiber.

The suction muffler 300 may include the muffler main body 310 movably accommodated into the muffler guide 180, a main body insertion portion 330 coupled to an inside of the muffler main body 310 and having a variable refrigerant passage section, and a piston insertion portion 350 coupled to the muffler main body 310 to extend into the piston 130.

The suction muffler 300 may be a three-stage coupling assembly including the muffler main body 310, the main body insertion portion 330, and the piston insertion portion 350. For convenience of description, the muffler main body 310, the main body insertion portion 330, and the piston insertion portion 350 may be referred to as "first, second, and third members", respectively.

The muffler main body 310 may have an approximately cylindrical shape. The muffler main body 310 may reciprocate forward or backward inside the muffler guide 180.

The muffler main body 310 may have a pipe through hole 312, through which the inflow pipe 182 may pass. The inflow pipe 182 may pass through the pipe through hole 312 to extend into the muffler main body 310.

When the muffler main body 310 moves in a backward direction (for example, to the right in FIG. 15), a length by which the inflow pipe 182 extends into the muffler main body 310 may be shortened. Thus, a distance between the inflow pipe 182 and the main body insertion portion 330 may increase (see FIG. 15).

On the other hand, when the muffler main body 310 moves in a forward direction (for example, to the left in FIG. 14), the length or amount by which the inflow pipe 182 extends into the muffler main body 310 may be elongated or increased. Also, the distance between the inflow pipe 182 and the main body insertion portion 330 may be decreased (see FIG. 14).

The main body insertion portion 330 may be accommodated in the muffler main body 310. The muffler main body 310 may include a wall 315, to which the main body insertion portion 330 may be coupled. The wall 315 may form at least a portion of an outer circumferential surface of the muffler main body 310.

The main body insertion portion 330 may include a first coupling rib 336 coupled to the wall 315. The first coupling rib 336 may be forcibly press-fitted into or to the wall 315.

In more detail, a press-fit rib 338, which may be press-fitted into or to the wall 315, may be provided on an outer circumferential surface of the first coupling rib 336. The press-fit rib 338 may protrude slightly from an outer circumferential surface of the first coupling rib 336. The first coupling rib 336 including the press-fit rib 338 may have a diameter slightly greater than an inner diameter of the muffler main body 310.

A plurality of press-fit rib 338 may be provided, and the plurality of press-fit ribs 338 may be spaced apart from each other. For example, each press-fit rib 338 may be disposed on a portion, on which a first mountain or protruding portion 337*a* is disposed, of the outer circumferential surface of the first coupling rib 336. Thus, as three first mountain portions 337*a* are provided in FIG. 5, three press-fit ribs 338 may be provided.

The main body insertion portion 330 may include a first inflow hole 331 to which refrigerant discharged from the pipe discharge hole 182*c* of the inflow pipe 182 may be introduced, a first flow guide 333 that extends from the first inflow hole 331, a second flow guide 335 that extends from the first flow guide 333, an external extension portion 335*a* that extends outward from the second flow guide 335, and the first coupling rib 336 bent from the external extension portion 335*a* to extend in a rearward direction (for example, to the right in FIG. 3).

The first inflow hole 331 may have a cross-section greater than a cross-section of the pipe discharge hole 182*c* of the inflow pipe 182. While refrigerant is suctioned, the first inflow hole 331 may be disposed at a position which is slightly spaced from the pipe discharge hole 1820.

The refrigerant discharged from the pipe discharge hole 182*c* may be spread due to the expansion in flow cross-section while the refrigerant is introduced into the first inflow hole 331. Thus, the refrigerant may increase in flow resistance to instantaneously reduce a flow rate of the refrigerant, thereby reducing noise.

The first flow guide 333 may be tilted from the first inflow hole 331 in a direction in which the flow cross-section thereof decreases downstream with respect to a flow direction of the refrigerant. Thus, the refrigerant may increase in flow rate due to the reduction in the flow resistance while passing through the first flow guide 333, and thus, suction efficiency of the refrigerant may be improved.

The second flow guide 335 may extend directly rearward from the first flow guide 333 toward the piston insertion portion 350, and the second flow guide 335 may have a flow cross-section less than the first flow cross-section. Thus, the flow rate accelerated while passing through the first flow guide 335 may be maintained by passing through the second flow guide 335.

The refrigerant passing through the second flow guide 335 may be discharged through a first discharge hole 339 to flow into an inner space defined by the first coupling rib 336 and a second coupling rib 356 of the piston insertion portion 350.

The first coupling rib 336 may extend from an edge of the external extension portion 335*a* and have an approximately circular shape. Also, the second coupling rib 356 may be coupled to the first coupling rib 336 and have an approximately circular shape corresponding to a shape of the first coupling rib 336.

A flow cross-section of an inner space between the first and second coupling ribs 336 and 356 may be greater than a flow cross-section of the first discharge hole 339. That is, as the external extension portion 335*a* radially extends to the outside of the first discharge hole 339, refrigerant discharged from the first discharge hole 339 may be reduced in flow rate while flowing into the inner space between the first coupling rib 336 and the second coupling rib 356, and thus, the refrigerant may be reduced in flow noise.

The second coupling rib 356 may be coupled to the wall 315 of the muffler main body 310. The second coupling rib 356 may be forcibly press-fitted to or into the wall 315, like the first coupling rib 336. A portion of the wall 315, to which the first coupling rib 336 may be coupled, may be referred to as a "first wall", and a portion of the wall 315 to which the second coupling rib 356 may be coupled may be referred to as a "second wall".

Each of the first and second coupling ribs 336 and 356 may include a rounded portion. The rounded portions may be coupled to each other.

In more detail, the first coupling rib 336 may have a preset curvature and include a first curved portion 337 disposed to face the piston insertion portion 350. The first curved portion 337 may define a surface of the first coupling rib 336 and be rounded to extend in a predetermined direction.

The first curved portion 337 may include a first mountain portion 337*a* rounded to protrude in a first direction and a first curved portion 337*b* recessed and rounded in a second direction. The first direction may be a rearward direction, and the second direction may be a frontward direction. The first mountain portion 337*a* may be referred to as a "first convex portion", and the first curved portion 337*b* may be referred to as a "first concave portion". A length by which the first mountain portion 337*a* protrudes from the external extension portion 335*a* may be greater than a length by which the first curved portion 337*b* protrudes from the external extension portion 335*a*.

The second coupling rib 356 may have a predetermined curvature and include a second curved portion 357 disposed to face the main body insertion portion 330. The second curved portion 357 may define a surface of the second coupling rib 356 and be rounded to extend in a predetermined direction. Also, the curved portion of the second curved portion 357 may be coupled to the curved portion of the first curved portion 337.

The second curved portion 357 may include a second mountain portion 357*a* rounded to protrude in a first direction and a second curved portion 357*b* recessed and rounded in a second direction. The first direction may be a frontward direction, and the second direction may be a rearward direction. The second mountain portion 357*a* may be referred to as a "second convex portion", and the second curved portion 357*b* may be referred to as a "second concave portion". A length by which the second mountain portion 357*a* protrudes from a second support 358 of the piston insertion portion 350 may be greater than a length by which the second curved portion 357*b* protrudes from the second support 358.

The first mountain portion 337*a* of the first curved portion 337 may be fitted into the second curved portion 357*b* of the second curved portion 357, and the second mountain portion 357*a* of the second curved portion 357 may be fitted into the first curved portion 337*b* of the first curved portion 337. As described above, as the first mountain portion 337*a* and the first curved portion 337*b* of the first curved portion 337 may be fitted into the second curved portion 357*b* and the second mountain portion 357*a* of the second curved portion 357, it may prevent the main body insertion portion 330 and the piston insertion portion 350 from idling while the suction muffler 300 moves.

Also, when the first coupling rib 336 and the second coupling rib 356 are coupled to each other, the first and second coupling ribs 336 and 356 may have an approximately cylindrical shape. Also, an inner space defined by the first and second coupling ribs 336 and 356 may provide a flow space, and a flow cross-section of the flow space may be greater than the flow cross-section of the first discharge hole 339.

The piston insertion portion 350 may extend backward in a state in which the piston insertion portion 350 is coupled to the muffler main body 310. The piston insertion portion 350 may include the second coupling rib 356, which may be press-fitted to or into the wall 315 of the muffler main body 310, a second inflow hole 351 defined inside the second coupling rib 356 to introduce the refrigerant discharged from the first discharge hole 339 into the piston insertion portion 350, and an insertion portion main body 352 that extends backward from the second inflow hole 351 to provide a flow space for the refrigerant.

The second inflow hole 351 of the piston insertion portion 350 may be spaced from the first discharge hole 339 of the main body insertion portion 330. A refrigerant passage cross-section (hereinafter, referred to as a "main body inner passage") of the space defined by the first and second coupling ribs 336 and 356 may be greater than a passage cross-section of the first discharge hole 339 or the second inflow hole 351. The main body inner passage may be defined between the first discharge hole 339 and the second inflow hole 351.

The piston insertion portion 350 may further include a second support 358 that extends in an outward radial direction of the second coupling rib 356 and coupled to the muffler main body 310. The muffler main body 310 may include a first support 318 coupled to the second support 358. The first support 318 may extend from the wall 315 of the muffler main body 310 in an external radial direction.

The first and second supports 318 and 358 may protrude at edges of the muffler main body 310 and the piston insertion portion 350. Thus, each of the first and second supports 318 and 358 may be referred to as an "edge extension portion" or a "wing portion". The coupled state of the muffler main body 310 and the piston insertion portion 350 may be stably maintained by the first and second supports 318 and 358 to prevent the muffler main body 310 and the piston insertion portion 350 from idling.

In the state in which the first and second supports 318 and 358 are coupled to each other, the first and second supports 318 and 358 may be interposed between a flange 133 of the piston 130 and a piston guide 134. The flange 133 may be a portion that extends outward from an end of the piston 130 and may be supported inside the connection member 138. The flange 133 may have an approximately disk shape.

The piston guide 134 may be coupled to the flange 133 and the connection member 138. That is, the piston guide 134 may be interposed between an outer surface of the flange 133 and an inner surface of the connection member 138.

The piston guide 134 may have an approximately disk shape. Also, the piston guide 134 may support the flange 300 to reduce a load acting on the piston 130 or the flange 300.

The first and second supports 318 and 358 may be fixed between the flange 133 and the piston guide 134. Thus, while the piston 130 reciprocates, the muffler main body 310 and the piston insertion portion 350 may be supported and reciprocated by the piston 130 due to the first and second supports 318 and 358.

The piston insertion portion 350 may further include a second discharge hole 359 to discharge refrigerant passing through an insertion portion main body 352. The second inflow hole 351 may form a first end of the insertion portion main body 352, and the second discharge hole 359 may form a second end of the insertion portion main body 352. The refrigerant discharged from the second discharge hole 359 may be suctioned into the compression space P via the suction hole 131*a* of the piston 130.

The piston insertion portion 350 may include a suction guide 360 disposed adjacent to the second discharge hole 359 to guide the refrigerant discharged from the second discharge hole 359 toward the suction hole 131*a*. The suction guide 360 may surround at least a portion of the insertion portion main body 352. In more detail, the suction guide 360 may include a first extension 362 that extends from a side of an outer circumferential surface of the insertion portion main body 352 in an external radial direction and a second extension 364 bent from the first extension 362 to extend rearward.

A storage space 365, in which at least a portion of the refrigerant suctioned into the compression space P may be defined as an opened space defined by the first extension 362, the second extension 364, and the insertion portion main body 352.

At least a portion of the refrigerant discharged from the second discharge hole 359 may reversely flow through a space between the piston 130 and the insertion portion main body 352 or may be swirled in a space around the second discharge hole 359. More particularly, the greater an amount of refrigerant suctioned into the compression space P, the more a flow rate of the refrigerant may increase. Thus, reverse flow and swirl of refrigerant may deteriorate suction efficiency.

The storage space 365 may stare the refrigerant to prevent the refrigerant from reversely flowing or being swirled. Also, the refrigerant stored in the storage space 365 may be suctioned into the compression space P when the refrigerant is again suctioned, and then compressed and discharged.

As described above, as the suction guide 360 may be provided at a position adjacent to the second discharge hole 359 to control a flow of the refrigerant, suction efficiency of the refrigerant may be improved.

Figure 6:
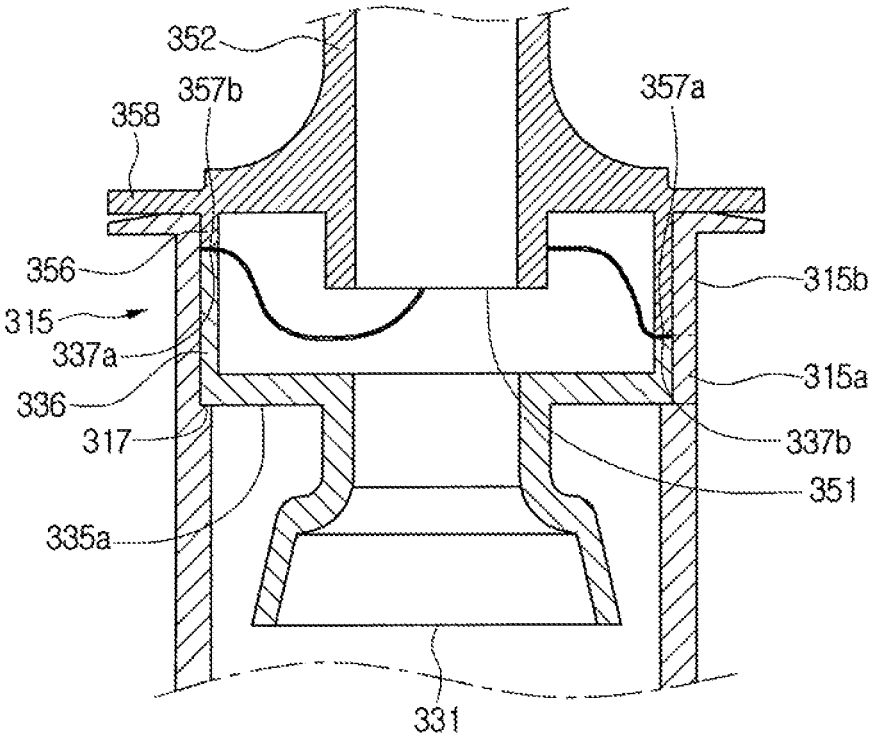
FIG. 6 is a cross-sectional view of a press-fit structure of the suction muffler according to an embodiment.

FIG. 6 is a cross-sectional view illustrating a press-fit structure of the suction muffler according to an embodiment. Referring to FIG. 6, the suction muffler according to an embodiment may include the main body insertion portion 330 accommodated in the muffler main body 310 and the piston insertion portion 350 coupled to the muffler main body 310 to extend to outside of the muffler main body 310.

The muffler main body 310 may include at least a portion of the main body insertion portion 330 and the wall 315 coupled to at least a portion of the piston insertion portion 350. The coupling may be performed through forcible press-fitting.

In more detail, the wall 315 may include a first wall 315*a*, to which the first coupling rib 336 of the main body insertion portion 330 may be coupled, and a second wall 315*b*, to which the second coupling rib 356 of the piston insertion portion 350 may be coupled. The second wall 315*b* may extend from the first wall 315*a*.

As described above, as each of the first and second coupling ribs 336 and 356 may be rounded, the first and second coupling ribs 336 and 356 may have lengths different from each other along an outer circumferential surface thereof. That is, a length by which the first coupling rib 336 protrudes from the external extension portion 335*a* may be different along the outer circumferential surface of the first coupling rib 336. Also, a length by which the second coupling rib 356 protrudes from the second support 358 may be different along the outer circumferential surface of the second coupling rib 356.

For example, referring to FIG. 6, the coupling rib 336 coupled to the right first wall 315*a* of the first coupling ribs 336 may have a relatively smaller length, while the coupling rib 336 coupled to the left first wall 315*a* may have a relatively greater length. Herein, the coupling rib 336 having the relatively less length may correspond to the portion on which the first curved portion 337*b* of the first curved portion 337 is formed, and the coupling rib 336 having the relatively greater length may correspond to the portion on which the first mountain portion 337*a* of the first curved portion 337 is formed.

Also, again referring to FIG. 6, the coupling rib 356 coupled to the right second wall 315*b* of the second coupling rib 356 may have a relatively greater length, while the coupling rib 356 coupled to the left second wall 315*b* may have a relatively smaller length. Herein, the coupling rib 356 having the relatively smaller length may correspond to the portion on which the second mountain portion 357*a* of the second curved portion 357 is formed, and the coupling rib 356 having the relatively greater length may correspond to the portion on which the second curved portion 357*b* of the second curved portion 357 is formed.

The muffler main body 310 may include a hook protrusion 317 that defines an end of the wall 315. The hook protrusion 317 may be recessed from an inner circumferential surface of the muffler main body 310 in an external radius direction, and thus, be stepped.

The hook protrusion 317 may be referred to as a portion on which at least a portion of the main body insertion portion 330 may be seated. The external extension portion 335*a* of the main body insertion portion 330 may be seated on the hook protrusion 317. Also, the first coupling rib 336 may extend backward from the hook protrusion 317 and then be coupled to the first wall 315*a*.

Hereinafter, an assembly process of the suction muffler according to an embodiment will be described.

Figure 7:
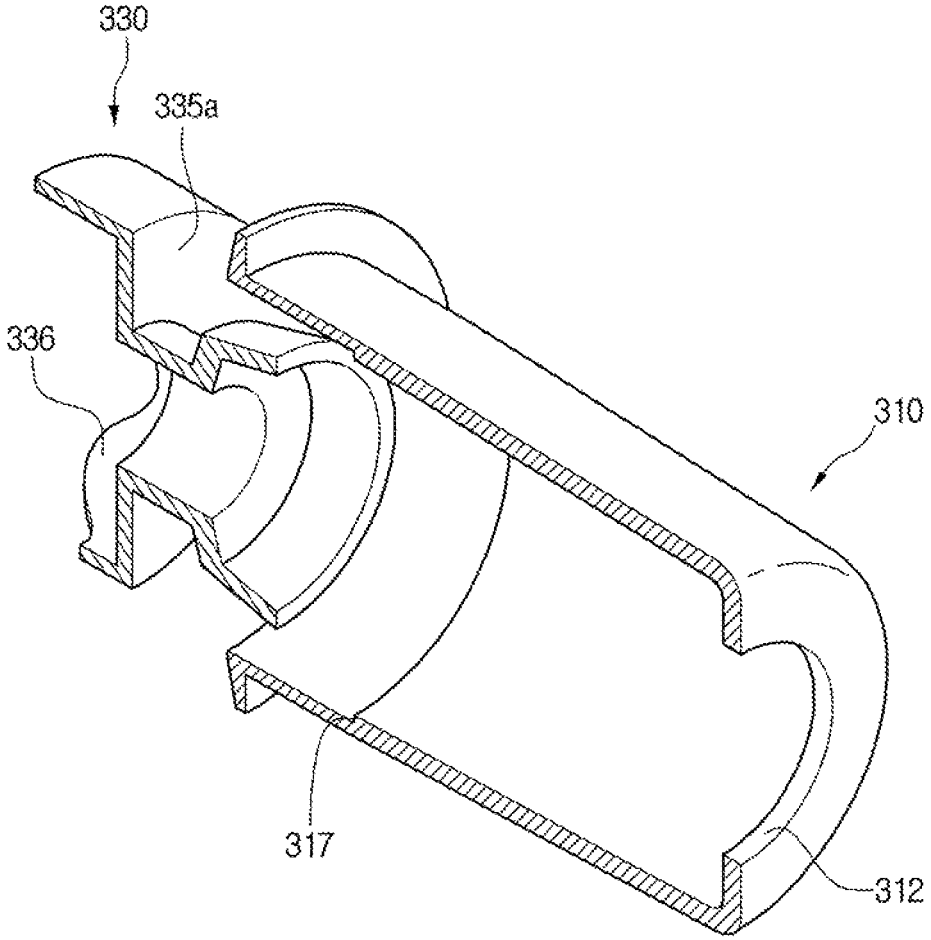
FIG. 7 is a cross-sectional perspective view illustrating a state before the main body insertion portion is press-fitted into the muffler main body according to an embodiment.
Figure 8:
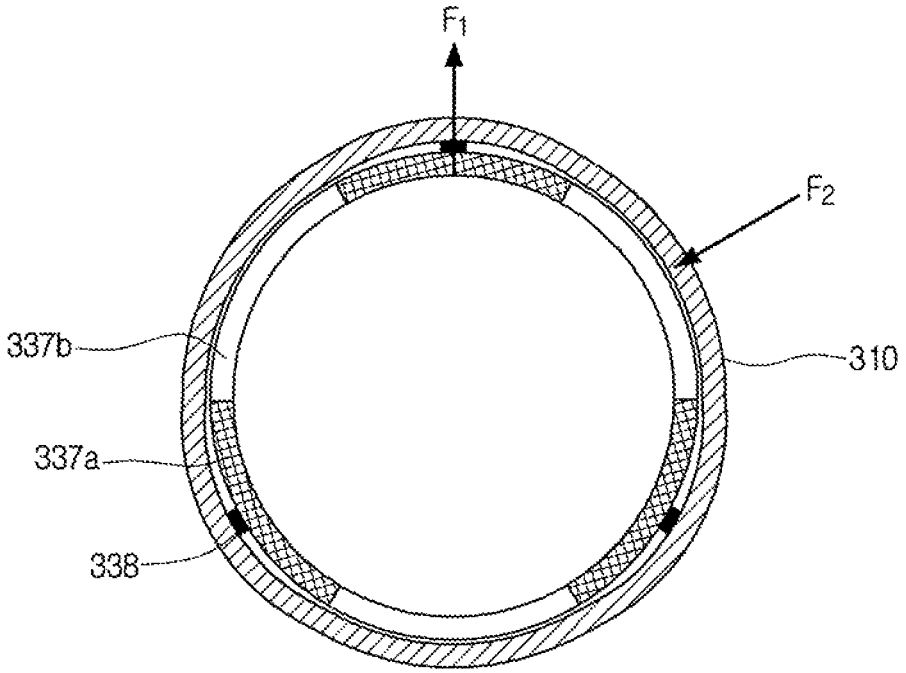
FIG. 8 is a cross-sectional view illustrating a state in which the main body insertion portion is press-fitted into the muffler main body according to an embodiment.
Figure 9:
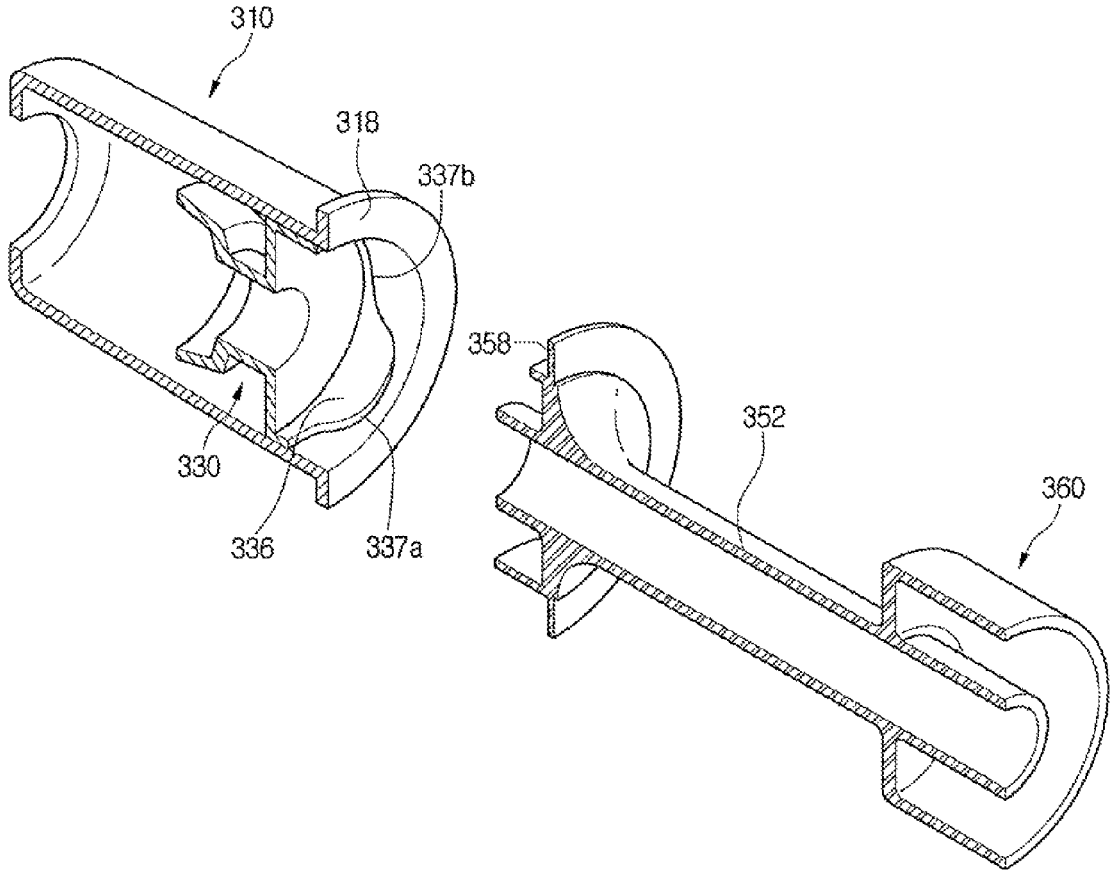
FIG. 9 is a cross-sectional perspective view illustrating a state before the piston insertion portion is press-fitted into the muffler main body according to an embodiment.
Figure 10:
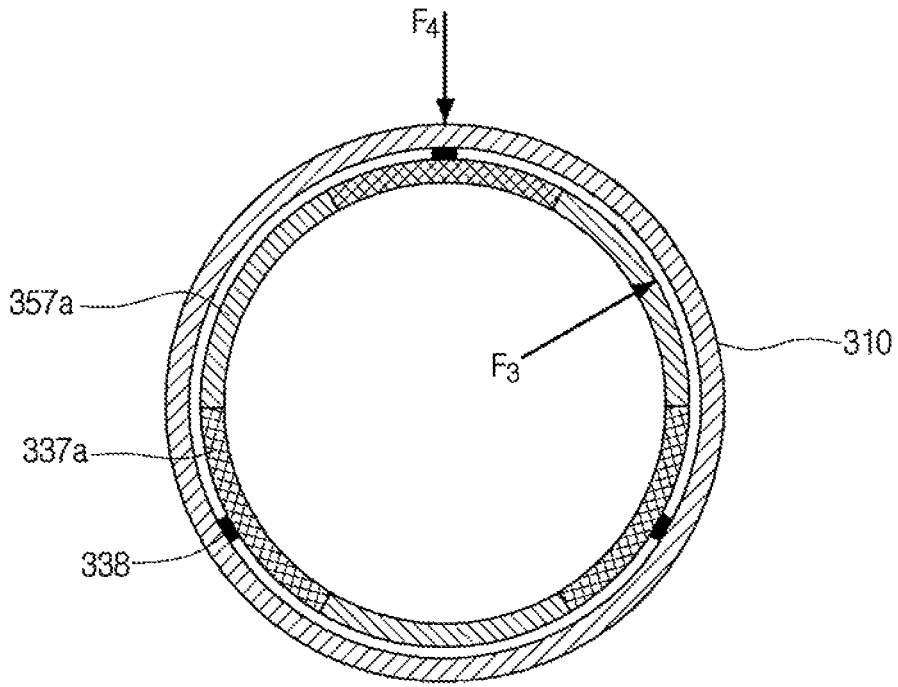
FIG. 10 is a cross-sectional view illustrating a state in which the piston insertion portion is press-fitted into the muffler main body according to an embodiment.

FIG. 7 is a cross-sectional perspective view illustrating a state before the main body insertion portion is press-fitted into the muffler main body according to an embodiment. FIG. 8 is a cross-sectional view illustrating a state in which the main body insertion portion is press-fitted into the muffler main body according to an embodiment. FIG. 9 is a cross-sectional perspective view illustrating a state before the piston insertion portion is press-fitted into the muffler main body according to an embodiment. FIG. 10 is a cross-sectional view illustrating a state in which the piston insertion portion is press-fitted into the muffler main body according to an embodiment.

A coupling process of the main body insertion portion 330 to the muffler main body 310 will be described with reference to FIG. 7. The muffler main body 310 may be press-fitted onto the main body insertion portion 330 so that the first inflow hole 331 of the main body insertion portion 330 may pass through to be disposed adjacent the pipe through hole 312 of the muffler main body 310. The main body insertion portion 330 may be inserted until the external extension portion 335*a* is hooked on the hook protrusion 317.

The main body insertion portion 330 may be coupled by being forcibly press-fitted into the muffler main body 310. As described above, at least one press-fit rib 338 may be provided on the outer circumferential surface of the first coupling rib 336 of the main body insertion portion 330, and the first coupling rib 336 including the press-fit rib 338 may have a diameter equal to or less than an inner diameter of the muffler main body 310.

Thus, while the main body insertion portion 330 is press-fitted, the muffler main body 310 and the main body insertion portion 330 may be elastically deformed. As each of the muffler main body 310 and the main body insertion portion 330 may be formed of a plastic material, there is no problem regarding elastic deformation.

FIG. 8 illustrates forces interacting between the main body insertion portion 330 and the muffler main body 310 when the main body insertion portion 330 is press-fitted into the muffler main body 310. When the main body insertion portion 330 is coupled to the muffler main body 310, a force F1 may act on the main body insertion portion 330 in an outward direction, and a force F2 may act on the muffler main body 310 in an inward direction.

In more detail, while the main body insertion portion 330 is press-fitted, a peripheral area of the muffler main body 310, to which the press-fit rib 338 may be coupled, may be deformed in the outward direction by the force F1, and an area except for the peripheral area may be deformed in the inward direction by the force F2. The deformation occurring during the press-fitting between the main body insertion portion 330 and the muffler main body 310 may be referred to as a "first deformation". The forces F1 and F2 may interact with each other to maintain the coupled state between the main body insertion portion 330 and the muffler main body 310.

A coupling process of the piston insertion portion 350 to the muffler main body 310 coupled to the main body insertion portion 330 will be described with reference to FIG. 9. The piston insertion portion 350 may be inserted into the muffler main body 310 so that the second coupling rib 356 of the piston insertion portion 350 may face the inside of the muffler main body 310.

The piston insertion portion 350 may be inserted until the second coupling rib 356 is coupled to the first coupling rib 336. The second mountain portion 357*a* of the second curved portion 357 of the second coupling rib 356 may be fitted into the first curved portion 337*b* of the first curved portion 337 of the first coupling rib 336, and the second curved portion 357*b* of the second curved portion 357 of the second coupling rib 356 may fitted into the first mountain portion 337*b* of the first curved portion 337 of the first coupling rib 336.

The piston insertion portion 350 may be coupled by being forcibly press-fitted into the muffler main body 310. As described with respect to FIG. 8, the force F2 may act on the muffler main body 310 in the inward direction. The muffler main body 310 in a state in which the main body insertion portion 310 is coupled may have an inner diameter equal to or slightly less than an outer diameter of the second coupling rib 356 of the piston insertion portion 350.

While the piston insertion portion 350 is press-fitted into the muffler main body 310, the muffler main body 310 or the piston insertion portion 350 may be elastically deformed. As each of the muffler main body 310 and the piston insertion portion 350 may be formed of a plastic material, there is no problem regarding elastic deformation.

FIG. 10 illustrates forces interacting between the main body insertion portion 330 and the muffler main body 310 when the main body insertion portion 330 is press-fitted into the muffler main body 310. As described with respect to FIG. 8, in the first deformation, the force F1 may act on the main body insertion portion 330 toward the muffler main body 310 in the outward direction, and force F2 may act on the muffler main body 310 toward the main body insertion portion 330 in the inward direction. Also, when the piston insertion portion 350 is forcibly press-fitted, a force F3 may act on the piston insertion portion 350 toward the muffler main body 310 in the outward direction, and a force F4 may act on the muffler main body 310 in the inward direction.

Thus, when the assembly of the suction muffler 300 is completed, the force F3 may act on the main body insertion portion 330 and the piston insertion portion 350 toward the muffler main body 310 in the outward direction, and the force F4 may act on the muffler main body 310 toward the main body insertion portion 330 and the piston insertion portion 350 in the inward direction.

In more detail, while the piston insertion portion 350 is press-fitted, an area that is deformed inward by the force F2 in the first deformation may be deformed outward by the force F3 that acts outward from the piston insertion part 350. Also, a portion of the muffler main body 310, which is deformed outward by the force F1 in the first deformation, may be deformed inward by the force F4. The deformation occurring during the press-fitting between the piston insertion portion 350 and the muffler main body 310 may be referred to as a "second deformation".

In summary, while the main body insertion portion 330 is press-fitted into the muffler main body 310, the first deformation force may act on at least a portion of the muffler main body 310. Also, while the piston insertion portion 350 is press-fitted into the muffler main body 310, a force to return to its original shape may act on the first deformation portion of the muffler main body 310.

Also, while the main body insertion portion 330 and the piston insertion portion 350 are press-fitted into the muffler main body 310, the forces F1, F2, F3, and F4 may be in an equilibrium state with respect to each other. Thus, the muffler main body 310, the main body insertion portion 330, and the piston insertion portion 350 may be firmly coupled to each other.

Figure 11:
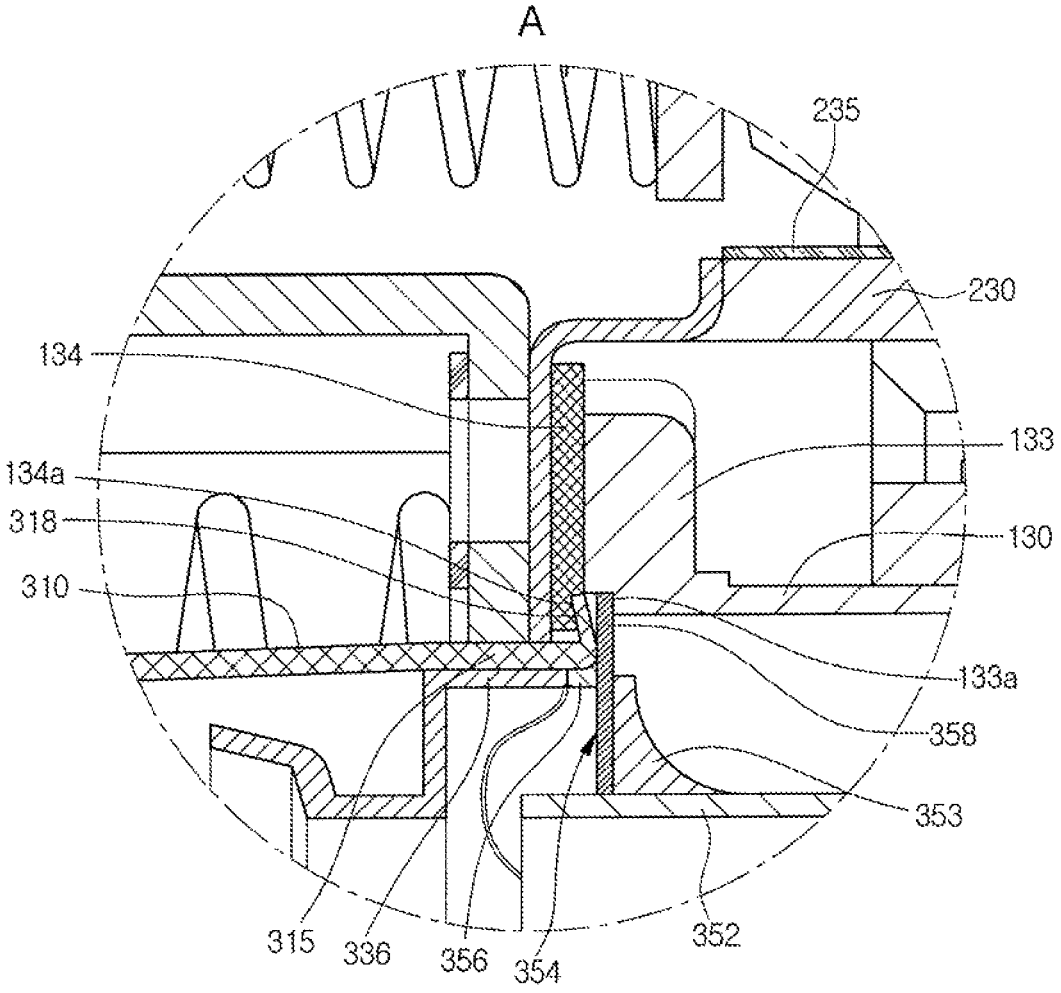
FIG. 11 is an enlarged cross-sectional view of a portion "A" of FIG. 1.
Figure 12:
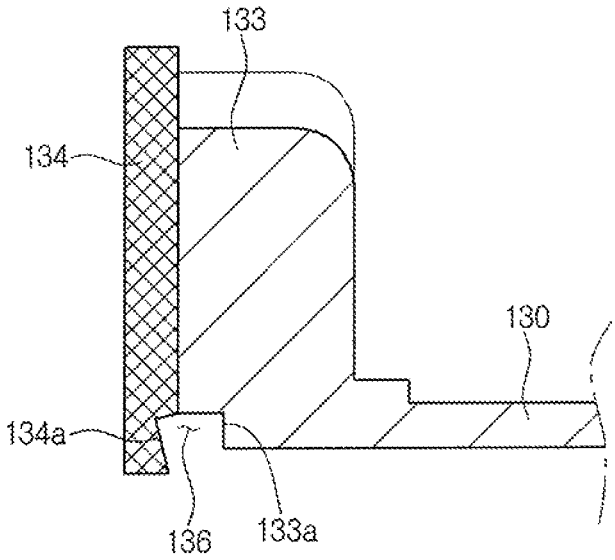
FIG. 12 is a cross-sectional view illustrating coupling structure of first and second supports according to an embodiment.
Figure 12:
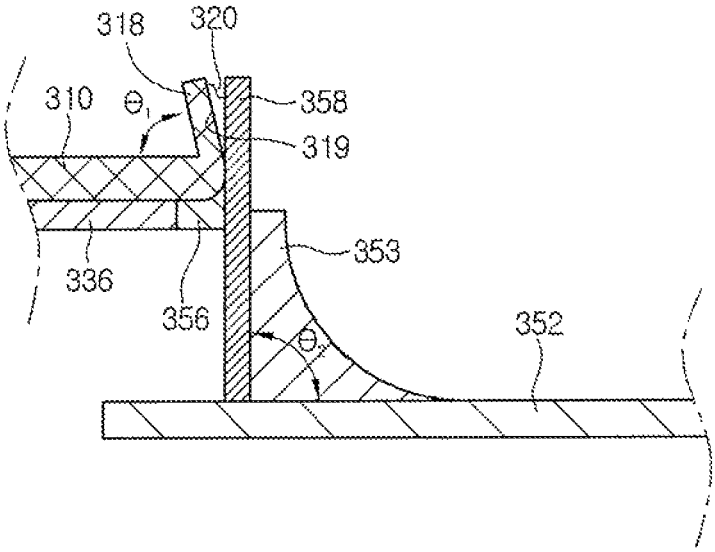

FIG. 11 is an enlarged cross-sectional view of a portion "A" of FIG. 1, and FIG. 12 is a cross-sectional view illustrating coupling structure of first and second supports according to an embodiment. Referring to FIGS. 11 and 12, the piston insertion portion 350 according to an embodiment may include a support plate 354 that surrounds at least a portion of the insertion portion main body 352. The support plate 354 may extend radially from an outer surface of the insertion portion main body 352 at a point spaced from the second inflow hole 351.

The support plate 354 may have an approximately disk shape. Also, the second coupling rib 356 may be coupled to the support plate 354 to extend in a direction forward.

A reinforcing rib 353 to reinforce the insertion portion main body 352, and the support plate 354 may be provided on an outer surface of the insertion portion main body 352. One surface of the reinforcing rib 353 may be coupled to the insertion portion main body 352, and the other surface may be coupled to the support plate 354. The insertion portion main body 352 and the support plate 354 may be firmly coupled to each other by the reinforcing rib 353.

A second support 358 coupled to the muffler main body 310 may be further provided on or at an edge of the support plate 354. The second support 358 may be understood as a portion of the support plate 354 that extends outward from an edge of the piston insertion portion 350. Also, the second support 358 may extend in an external radial direction of the second coupling rib 356.

The muffler main body 310 may include a first support 318 coupled to the second support 358. The first support 318 may extend from the wall 315 of the muffler main body 310 in an external radial direction.

A first seat portion 133*a*, on which at least a portion of the second support 358 may be seated, may be formed on the flange 133. The first seat portion 133*a* may be formed by recessing a surface of the flange 133. An end of the second support 358 may be seated or coupled to the first seat portion 133*a*.

Also, the piston guide 134 may be coupled to the flange 133 and the connection member 138. The connection member 138 may be coupled to a permanent magnet 230. A taping member 235 may be disposed outside the permanent magnet 230. The taping member 235 may be formed by mixing a glass fiber and a resin. The taping member 235 may firmly maintain the coupled state between the permanent magnet 230 and the connection member 138.

The piston guide 134 may have a first surface coupled to the flange 133 and a second surface coupled to the connection member 138. That is, the piston guide 350 may be coupled between an outer surface of the flange 133 and an inner surface of the connection member 138.

A second seat portion 134*a* on which at least a portion of the first support 318 may be seated, may be formed on the piston guide 134. The second seat portion 134*a* may be formed by recessing a surface of the flange 134. An end of the first support 318 may be seated or coupled to the second seat portion 134*a*.

The flange 133 and the piston guide 134 may define an accommodation space 136 to accommodate at least a portion of each of the first and second supports 318 and 358. In more detail, the accommodation space 136 may be a space having one opened surface, which may be defined by the first seat portion 133*a* of the flange 133 and the second seat portion 134*a* of the piston guide 134.

In the state in which the first and second supports 318 and 358 are coupled to each other, ends of each of the first and second supports 318 and 358 may be inserted into the accommodation space 136. Thus, while the piston 130 reciprocates, the muffler main body 310 and the piston insertion portion 350 may be supported and reciprocated by the piston 130 due to the first and second supports 318 and 358.

The first support 318 may be inclined in as outward direction with respect to the muffler main body 310. In more detail, the first support 318 and the muffler main body 310 may have a first predetermined angle θ1 therebetween. For example, the first predetermined angle θ1 may be an acute angle.

On the other hand, the second support 358 may have a second predetermined angle θ2 with respect to an extension direction of the insertion portion main body 352. For example, the second predetermined angle θ2 may be a right angle.

On the basis of the extension direction of the first and second supports 318 and 358, at least a portion of the first support 318 may be coupled or contact the second support 358, and a remaining portion may be spaced apart from the second support 358. The portion coupled may be referred to as a "coupling portion", and the remaining portion may be a portion formed on an end of the first support 318, and thus, may be referred to as a "spaced portion".

In more detail, a space 320 to space at least a portion of the first support 318 from the second support 358 may be defined between the first and second supports 318 and 358. In a state in which the linear compressor 10 does not operate, the portion of the first support 318 and the second support 358 may be spaced apart from each other by the space 320.

As described above, in the state in which the first and second supports 318 and 358 are coupled to each other so that the portion of the first support 318 is spaced apart from the second support 358, the first and second supports 318 and 358 may be disposed within the accommodation space 136.

When the linear compressor 10 operates, while the suction muffler 300 moves together with the piston 130, the first support 318 may be elastically deformed. Thus, a whole portion of the first support 318 may be coupled to the second support 358. More particularly, as the suction muffler 300 moves forward or backward, the space may be selectively coupled to the second support 358. For example, while the suction muffler 300 moves backward, the space 320 may be elastically deformed and thus coupled to the second support 358. On the other hand, while the suction muffler 300 moves forward, the space 320 may be elastically deformed again and thus spaced apart from the second support 358.

Figure 13:
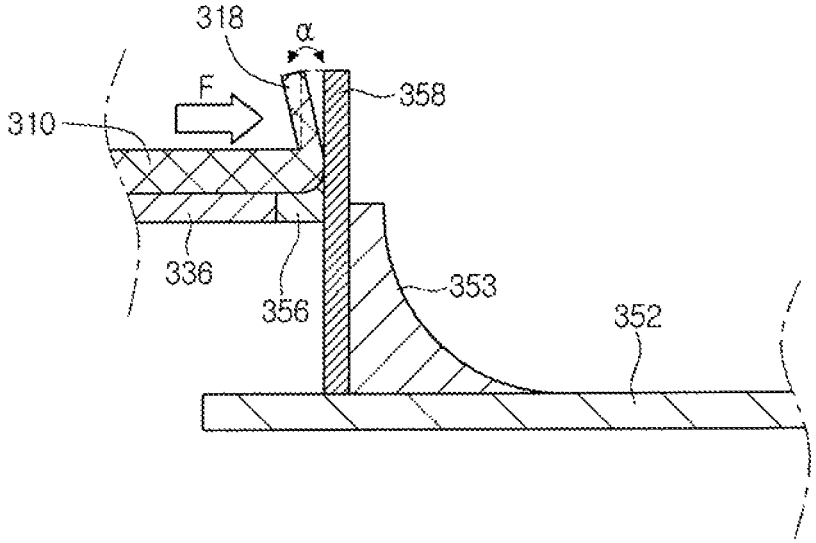
FIG. 13 is a cross-sectional view illustrating an operation of the first support according to an embodiment.

FIG. 13 is a cross-sectional view illustrating an operation of the first support according to an embodiment. Referring to FIG. 13, the suction muffler 300 according to an embodiment may reciprocate forward and backward together with the piston 130.

In the state in which the linear compressor 10 does not operate, an end of the first support 318 may be spaced apart from the second support 358 by space 320. Also, when the linear compressor 10 operates to allow the permanent magnet 230 to move backward, the connection member 138 may press the piston guide 134 and the flange 133 from a rear side to allow the piston 130 to move backward.

With this process, the first support 318 may be pressed from the piston guide 134 and thus elastically deformed. Thus, the first support 318 may be coupled or contact the second support 358, eliminating the space 320. This phenomenon may be maintained until the piston 130 reaches a top dead center (TDC) position (see FIG. 15).

When the piston 130 moves forward from the TOG position to a bottom dead center (BDC) position, the pressing force applied to the first support 318 may be released. Thus, the first support 318 may be elastically deformed again, and the space 320 may be provided between the first support 318 and the second support 358 (see FIG. 14).

As described above, while the suction muffler 300 reciprocates forward and backward, the first support 318 may be attached to and detached from the second support 358 repeatedly. When the linear compressor 10 operates, an internal temperature of the cylinder 120 and the piston 130 may increase to about 100℃. Under the high temperature environment, if the first and second supports 318 and 358 are in contact with each other on or at a wide area thereof, the first or second support 318 or 358 may be plastically deformed by the force or stress transmitted from the flange 13 and the piston guide 134. Thus, according to this embodiment, the space 320 may be selectively provided between the first support 318 and the second support 358 to reduce the force or stress transmitted into the first and second supports 318 and 358.

As a result, plastic deformation of the suction muffler 300 may be reduced by the first and second supports 318 and 358. Also, the supported state of the muffler main body 310 and the piston insertion portion 350 may be firmly maintained.

Another embodiment will now be described. The foregoing embodiment has a feature in that the first support 318 may extend at an acute angle with respect to the muffler main body 310, and the second support 358 may perpendicularly extend with respect to the piston insertion portion 350. However, the second support 358 may extend at an acute angle with respect to the piston insertion portion 350, and the first support 318 may perpendicularly extend with respect to the muffler main body 310. Due to the above-described configurations, while the compressor 10 operates, the first and second supports 318 and 358 may be selectively coupled to or separated from each other.

In summary, as one support of the supports of the muffler main body and the piston insertion portion may be tilted to allow the supports to be selectively coupled to or separated from each other while the compressor operates, an excessive load (or stress) may be prevented from acting on the muffler main body or the piston insertion portion.

Figure 14:
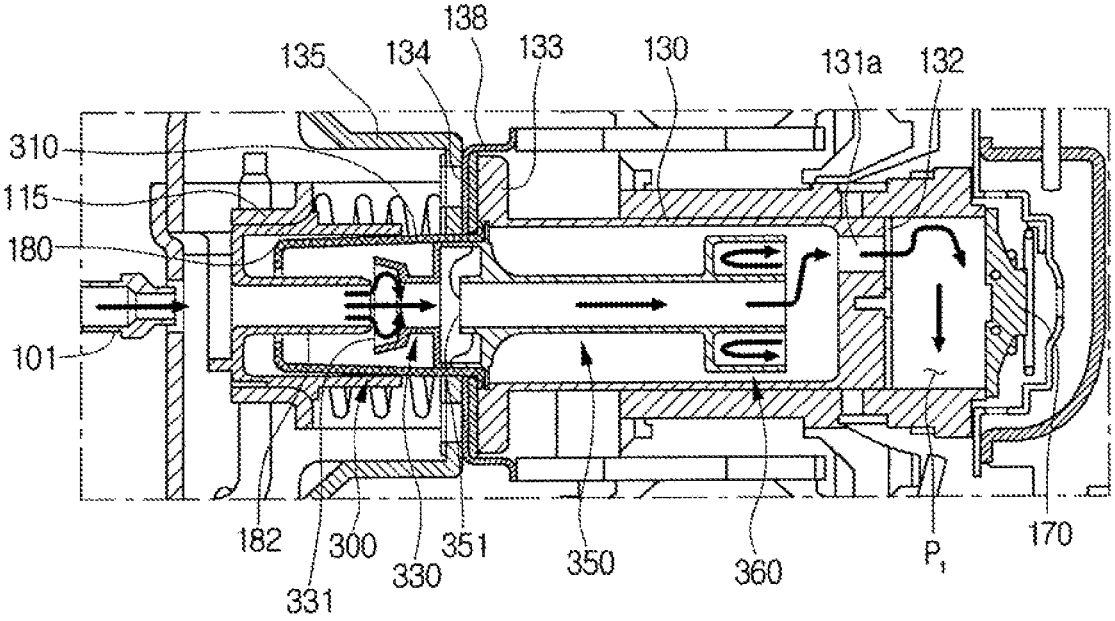
FIG. 14 is a cross-sectional view illustrating a position of the suction muffler when a piston is positioned at a first position according to an embodiment.
Figure 15:
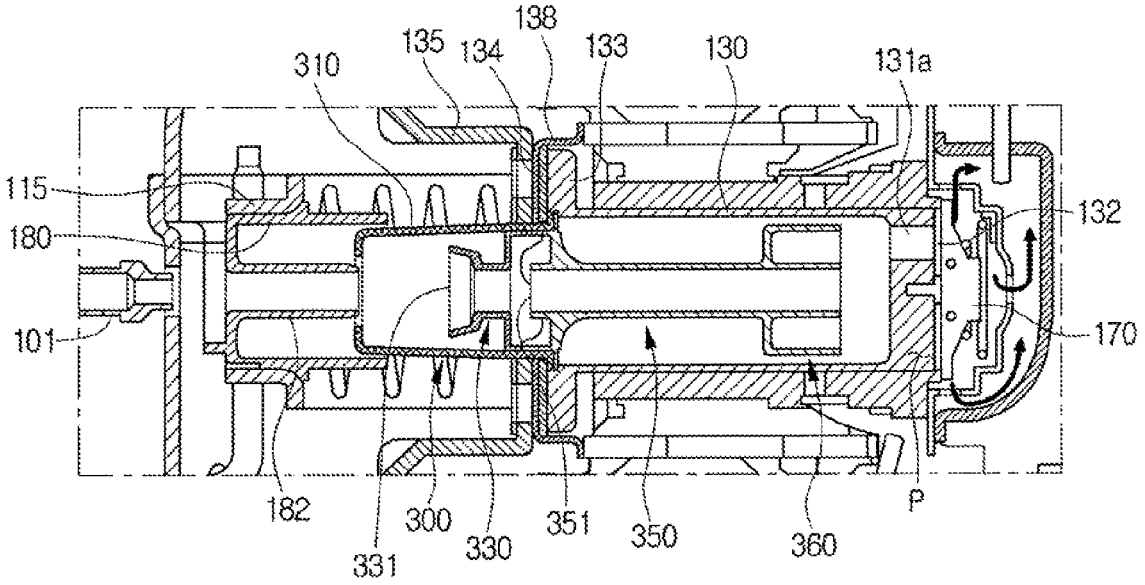
FIG. 15 is a cross-sectional view illustrating a position of the suction muffler when the piston is positioned at a second position according to an embodiment.

FIG. 14 is a cross-sectional view illustrating a position of the suction muffler when a piston is positioned at a first position according to an embodiment. FIG. 15 is a cross-sectional view illustrating a position of the suction muffler when the piston is positioned at a second position according to an embodiment.

FIG. 14 illustrates an inner configuration of the compressor 10 when the piston 130 is positioned at a first position according to an embodiment. Herein, the term "first position" may refer to the bottom dead center (BDC) position of the piston 130.

When the motor assembly 200 operates, and the permanent magnet 230 may move in a first direction (a left or forward direction in FIG. 14), the piston 130 coupled to the permanent magnet 230 may also move in the first direction. Also, the suction muffler 300 coupled to the permanent magnet 230 may move in the first direction.

As the permanent magnet moves, the compression space P may be expanded to form a pressure P1. The pressure P1 may be less than a suction pressure. Thus, the refrigerant may pass through the suction muffler 300 and then be suctioned into the compression space P through the opened suction valve 132. In more detail, as the permanent magnet 230 moves forward, the suction muffler 300 may move forward. As the first support 318 of the muffler main body 310 and the second support 358 of the piston insertion portion 350 are interposed between the flange 133 and the piston guide 134 in the state in which the first and second supports 318 and 358 are coupled to each other, the suction muffler 300 may receive a drive force by the piston 130.

As the suction muffler 300 moves forward, the inflow pipe 182 may be inserted into the muffler main body 310 through the pipe through hole 312. As the inflow pipe 182 is inserted, the pipe discharge hole 182*c* of the inflow pipe 182 and the first inflow hole 331 of the main body insertion portion 330 may be disposed adjacent to each other. Thus, as the refrigerant introduced through the inflow pipe 182 may easily flow into the main body insertion portion 330 through the first inflow hole 331, refrigerant passage losses may be reduced, and thus, compression efficiency may be improved.

The refrigerant discharged from the pipe discharge hole 182*c* may flow into the main body insertion portion 330 through the first inflow hole 331. As the first inflow hole 331 has a diameter greater than a diameter of the pipe discharge hole 182*c*, the flow rate of the refrigerant may be reduced to reduce noise. For example, noise corresponding to a middle frequency band of about 1 KHz to about 2.5 KHz may be reduced.

The refrigerant introduced into the main body insertion portion 330 through the first inflow hole 331 may be discharged through the first discharge hole 339 via the first and second flow guides 333 and 335.

The first flow guide 333 may extend backward so that a passage cross-section thereof decreases, and the second flow guide 335 may have a passage cross-section less than a passage cross-section of the first flow guide 333. Thus, while the refrigerant passes through the first and second flow guides 333 and 335, a flow rate of the refrigerant may increase.

The refrigerant discharged from the first discharge hole 339 may be introduced into the second inflow hole 351 of the piston insertion portion 350 via the main body inner passage. The main body inner passage may be a refrigerant passage between the first discharge hole 339 and the second inflow hole 351. The main body inner passage may have a cross-section greater than the passage cross-section of each of the first discharge hole 339 and the second inflow hole 351.

The refrigerant may be spread while flowing into the main body inner passage. Thus, the refrigerant may be reduced in flow rate to reduce noise. For example, noise corresponding to a high frequency band of about 4 KHz to about 5 KHz may be reduced.

Also, while the refrigerant is introduced from the main body inner passage to the second inflow hole 351, the refrigerant may increase in flow rate to improve suction efficiency.

The refrigerant introduced through the second inflow hole 351 may flow into the insertion portion main body 352 and then be discharged into the second discharge hole 359. The discharged refrigerant may be suctioned into the compression space P through the suction hole 131*a*.

At least a portion of the refrigerant discharged from the second discharge hole 359 may be stored in the storage space 365 defined in the suction guide 360 to prevent the refrigerant from leaking forward. That is, due to the storage space 365 in the suction guide 360, the refrigerant that reversely flows forward from the piston 130 or the refrigerant swirled around the second discharge hole 359 may be reduced into the storage space 365. Thus, suction efficiency of the refrigerant may be improved.

The suction guide 360 may serve as a Helmholtz resonator. The Helmholtz resonator may be understood as an acoustic device having small holes or narrow spaces (neck portions) to resonate air at a specific frequency to absorb noises.

The neck portions may be formed by narrow spaces between the second extension portion 364 of the suction guide 360 and the inner surface of the piston 130 to generate resonance, thereby absorbing noise. As a result, the resonance may be generated by the suction guide 360 to reduce the noise. For example, noises corresponding to a low frequency band of about 5 KHz to about 600 Hz may be reduced.

FIG. 15 illustrates an inner configuration of the compressor 10 when the piston 130 is positioned at a second position according to an embodiment. Herein, the term "second position" may refer to the top dead center (TDC) position of the piston 130. The position of the piston in FIG. 2 may be a "third position" between the BDC and TDC position.

In the state of FIG. 14, when the refrigerant is completely suctioned into the compression space P, the permanent magnet 230 may moves in the other direction (a right direction or rearward direction in FIG. 14). Thus, the piston 130 and the suction muffler 300 may move backward. In this process, the piston 130 may compress the refrigerant within the compression space P, and the first inflow hole 331 of the main body insertion portion 330 may be positioned away from the inflow pipe 182.

When the refrigerant pressure within the compression space P is greater than a discharge pressure, the discharge valve 170 may be opened. Thus, the refrigerant may flow into the inner space of the discharge muffler 176 through the opened discharge valve 176. The discharge muffler 176 may reduce flow noise of the compressed refrigerant. Also, the refrigerant may be introduced into the loop pipe 178 via the discharge muffler 176 and then be guided to the discharge 105.

According to embodiments, the muffler main body provided movable along a reciprocating motion of the piston and the plurality of insertion portions coupled to the muffler main body may be provided to reduce flow noise between the refrigerants in the suction muffler. Also, as the plurality of insertion portions may be press-fitted and coupled into the muffler main body, the muffler main body and the plurality of insertion portions may be firmly coupled to each other. Further, as each of the muffler main body and the plurality of insertion portions may be formed of plastic material and elastically deformed, coupling may be easily performed through the press-fitting.

Also, the main body insertion portion may be press-fitted into the muffler main body, and then, the piston insertion portion may be press-fitted. Thus, an inward force may act on the muffler main body, and an outward force may act on the insertion portions to maintain balance in force, thereby effectively assembling the suction muffler.

Also, the main body insertion portion and the piston portion may include coupling ribs, which match or correspond in shape. Also, as the coupling ribs may be press-fitted into the inner wall of the muffler main body, the muffler may be firmly assembled without providing a separate coupling member.

Also, as the curved portion may be provided on each of the coupling ribs, and the rounded portions may be fitted with respect to each other, the main body insertion portion and the piston insertion portion may be firmly coupled to each other to prevent the insertion portions from idling with respect to each other.

Also, as the muffler may be formed of a plastic material, heat loss through the muffler due to refrigerant flow may be reduced.

Embodiments disclosed herein provide a linear compressor including a muffler device capable of reducing noise.

Embodiments disclosed herein provide a linear compressor that may include a shell including a refrigerant inlet; a cylinder provided within the shell, a piston that reciprocates within the cylinder; and a suction muffler provided movable together with the piston. The suction muffler may include a muffler main body that defines a refrigerant passage; a main body insertion part or portion press-fitted into the muffler main body; and a piston insertion part or portion press-fitted into the muffler main body to extend into the piston. The piston insertion part may match or correspond to the main body insertion part in configuration.

The muffler main body may include a wall that defines at least one portion of an inner circumferential surface of the muffler main body. The wall may include a first wall, to which at least one portion of the main body insertion part may be coupled, and a second wall that extends from the first wall and to which at least one portion of the piston insertion part may be coupled.

The main body insertion part may include a flow guide that defines a passage of a refrigerant, and a first coupling rib provided on one side of the flow guide. The first coupling rib may be press-fitted into the first wall.

The muffler main body may include a hook protrusion or hook having a stepped portion or step, and the main body insertion part may include an external extension portion that extends from the flow guide to the first coupling rib. The external extension portion may be seated on the hook protrusion. The first coupling rib may have a preset or predetermined curvature and include a first curved part or portion disposed to face the piston insertion part.

The piston insertion part may include a main body disposed within the piston to guide a flow of a refrigerant, and a second coupling rib provided on one side of the main body. The second coupling rib may be press-fitted into the second wall. The second coupling rib may have a preset curvature and include a second curved part or portion disposed to face the main body insertion part.

The linear compressor may further include a first curved part or portion provided on the main body insertion part, and a second curved part or portion provided on the piston insertion part. The second curved part may be coupled to a curved portion of the first curved part.

The first curved part may include a first convex portion that protrudes in one or a first direction, and a first concave portion recessed in the other or a second direction. The second curved part may include a second convex portion that protrudes in the other direction, the second convex portion being coupled to the first concave portion, and a second concave portion recessed in the one direction. The second concave portion may be coupled to the first convex portion.

The linear compressor may further include a first support provided on an outer surface of the muffler main body; a second support provided on the piston insertion part, the second support being coupled to the first support, wherein the first support may include a coupling portion coupled to the second support; and a spaced portion spaced apart from the second support. The first support may extend outward from the muffler main body at a first set angle. The first set angle may be an acute angle.

The first support may be formed of an elastically deformable material. The first support may be deformed so that the spaced portion may be selectively coupled to the second support along a moving direction of the suction muffler.

The linear compressor may further include a flange part or flange that extends outward from the piston, and a first seat part or seat disposed on the flange part and on which at least one portion of the second support may be seated. The linear compressor may further include a piston guide coupled to one surface of the flange part, and a second seat part disposed on the piston guide and on which at least one portion of the first support is seated. The linear compressor may additionally include an accommodation space defined by recessed configurations of the first and second seat parts and in which the first and second supports may be disposed.

The main body insertion part may include a first flow guide that extends so that a flow cross-section gradually decreases downstream with respect to a flow direction of a refrigerant, and a second flow guide that extends from the first flow guide to the piston insertion part. The second flow guide may have a passage cross-section less than that of the first flow guide. The main body insertion part may further include a first inflow hole to introduce the refrigerant into the first flow guide, the first inflow hole having a diameter greater than that of the inflow pipe, and a first discharge hole to discharge the refrigerant passing through the second flow guide.

The linear compressor may further include an inflow pipe disposed inside the shell and through which the refrigerant suctioned from the refrigerant suction part may flow. The inflow pipe may pass through an inflow hole of the muffler main body.

While the suction muffler reciprocates together with the piston, the first inflow hole may be away from the inflow pipe or come close to the inflow pipe.

The piston insertion part may include a second inflow hole spaced apart from the first discharge hole, an insertion part main body that extends from the second inflow hole to the inside of the piston, and a second discharge hole through which the refrigerant passing through the insertion part main body may be discharged.

The linear compressor may further include a suction hole defined in the piston to allow the refrigerant passing through the suction muffler to be suctioned into a compression space of the cylinder, and a suction guide part or guide coupled to an end of the piston insertion part to guide the refrigerant discharged from the piston insertion part to the suction hole. The suction guide part may include a first extension portion that extends outward from an outer circumferential surface of the piston insertion part, and a second extension portion bent from the first extension portion to extend.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a shell including a refrigerant inlet;

a cylinder provided within the shell;

a piston that reciprocates within the cylinder to compress a refrigerant; and a suction muffler provided movable together with the piston, wherein the suction muffler includes:

a muffler main body that defines a refrigerant passage;

a main body insertion portion press-fitted into the muffler main body and having a first curved portion thereon, the first curved portion including:

at least one first convex portion that protrudes in a first direction; and at least one first concave portion recessed in a second direction; and a piston insertion portion press-fitted into the muffler main body to extend into the piston and having a second curved portion thereon, the second curved portion being coupled to the first curved portion such that the main body insertion portion portion and the piston insertion portion are coupled to each other.

2. The linear compressor according to claim 1, wherein the muffler main body includes a wall that defines at least a portion of an inner circumferential surface of the muffler main body.

3. The linear compressor according to claim 2, wherein the wall includes:

a first wall to which at least a portion of the main body insertion portion is coupled; and a second wall that extends from the first wall and to which at least a portion of the piston insertion portion is coupled.

4. The linear compressor according to claim 3, wherein the main body insertion portion includes:

a flow guide that defines a passage of a refrigerant; and a first coupling rib provided on a first side of the flow guide, the first coupling rib being press-fitted into the first wall.

5. The linear compressor according to claim 4, wherein the muffler main body includes a hook protrusion having a step, wherein the main body insertion portion includes an external extension portion that extends from the flow guide to the first coupling rib, the external extension portion being seated on the hook protrusion.

6. The linear compressor according to claim 4, wherein the first coupling rib includes a first curved portion disposed to face the piston insertion portion and having a predetermined curvature.

7. The linear compressor according to claim 4, wherein the piston insertion portion includes:

a main body provided within the piston to guide a flow of refrigerant; and a second coupling rib provided on a first side of the main body, the second coupling rib being press-fitted to the second wall.

8. The linear compressor according to claim 7, wherein the second coupling rib includes a second curved portion disposed to face the main body insertion portion and having a predetermined curvature.

9. The linear compressor according to claim 1, wherein the second curved portion includes:

at least one second convex portion that protrudes in the second direction, the at least one second convex portion being coupled to the at least one first concave portion; and at least one second concave portion recessed in the first direction, the at least one second concave portion being coupled to the at least one first convex portion.

10. The linear compressor according to claim 1, wherein the main body insertion portion includes:

a first flow guide having a first passage cross-sectional area, the first passage cross-sectional area gradually decreasing downstream with respect to a flow direction of refrigerant; and a second flow guide that extends from the first flow guide toward the piston insertion portion, the second flow guide having a second passage cross-sectional area less than the first passage cross-sectional area.

11. The linear compressor according to claim 10, further including:

an inflow pipe provided inside the shell and through which the refrigerant suctioned in through the refrigerant inlet flows, wherein the inflow pipe passes through an inflow hole of the muffler main body.

12. The linear compressor according to claim 11, wherein further the main body insertion portion further includes:

a first inflow hole to introduce the refrigerant into the first flow guide, the first inflow hole having a diameter greater than a diameter of the inflow pipe; and a first discharge hole to discharge the refrigerant flowing through the second flow guide.

13. The linear compressor according to claim 12, wherein, while the suction muffler reciprocates together with the piston, the first inflow hole is moved away from the inflow pipe or comes close to the inflow pipe.

14. The linear compressor according to claim 12, wherein the piston insertion portion includes:

a second inflow hole spaced apart from the first discharge hole;

an insertion portion main body that extends from the second inflow hole to an inside of the piston; and a second discharge hole, through which the refrigerant flowing through the insertion portion main body is discharged.

15. The linear compressor according to claim 1, further including:

a suction hole defined in the piston to allow the refrigerant passing through the suction muffler to be suctioned into a compression space of the cylinder; and a suction guide coupled to an end of the piston insertion portion to guide the refrigerant discharged from the piston insertion portion to the suction hole.

16. The linear compressor according to claim 15, wherein the suction guide includes:

a first extension that extends outward from an outer circumferential surface of the piston insertion portion; and a second extension bent from the first extension.

17. The linear compressor according to claim 1, wherein an outer diameter of a first coupling rib of the main body insertion portion is greater than an inner diameter of the muffler main body.

18. The linear compressor according to claim 17, wherein an outer diameter of a second rib of the piston insertion portion is greater than an inner diameter of the muffler main body.

19. A linear compressor, comprising:

a shell including a refrigerant inlet;

a cylinder provided within the shell;

a piston that reciprocates within the cylinder to compress a refrigerant and includes a flange which extends outward from the piston;

a piston guide coupled to a surface of the flange; and a suction muffler provided movable together with the piston, wherein the suction muffler includes:

a muffler main body that defines a refrigerant passage and includes a first support provided on an outer surface thereof;

a main body insertion portion inserted into the muffler main body;

a piston insertion portion coupled to the muffler main body to extend into the piston, the piston insertion portion having a second support coupled to the first support;

a first seat provided on the flange and in which at least a portion of the second support is seated; and a second seat provided on the piston guide and in which at least a portion of the first support is seated.

20. The linear compressor according to claim 19, wherein the first support includes:

a coupling portion coupled to the second support; and a spaced portion spaced apart from the second support.

21. The linear compressor according to claim 19, wherein the first support is formed of an elastically deformable material.

22. The linear compressor according to claim 20, wherein the first support is deformed so that the spaced portion is selectively coupled to the second support along a moving direction of the suction muffler.

23. A linear compressor, comprising:

a shell including a refrigerant inlet;

a cylinder provided within the shell;

a piston that reciprocates within the cylinder to compress a refrigerant; and a suction muffler provided movable together with the piston, wherein the suction muffler includes:

a muffler main body that defines a refrigerant passage and includes a first support provided on an outer surface thereof;

a main body insertion portion inserted into the muffler main body; and a piston insertion portion coupled into the muffler main body to extend into the piston, the piston insertion portion having a second support coupled to the first support, wherein the first support extends outward from the muffler main body at a first predetermined angle, and wherein the first predetermined angle is an acute angle.

24. The linear compressor according to claim 23, wherein the first support includes:

a coupling portion coupled to the second support; and a spaced portion spaced apart from the second support.

25. The linear compressor according to claim 23, wherein the first support is formed of an elastically deformable material.

26. The linear compressor according to claim 24, wherein the first support is deformed so that the spaced portion is selectively coupled to the second support along a moving direction of the suction muffler.

* * * * *